US012736278B2

(12) United States Patent
Kim et al.

(10) Patent No.: US 12,736,278 B2
(45) Date of Patent: Sep. 15, 2026

(54) REFRIGERATOR AND HOME APPLIANCE

(71) Applicant: LG Electronics Inc., Seoul (KR)

(72) Inventors: Kyoungjoung Kim, Seoul (KR); Seungil Lee, Seoul (KR); Hophil Lee, Seoul (KR); Misun Park, Seoul (KR)

(73) Assignee: LG Electronics Inc., Seoul (KR)

( * ) Notice: Subject to any disclaimer, the term of this patent is extended or adjusted under 35 U.S.C. 154(b) by 359 days.

(21) Appl. No.: 18/224,961

(22) Filed: Jul. 21, 2023

(65) Prior Publication Data

US 2024/0027124 A1 Jan. 25, 2024

(30) Foreign Application Priority Data

Jul. 22, 2022 (KR) ..... 10-2022-0090919
Nov. 7, 2022 (KR) ..... 10-2022-0146909

(51) Int. Cl.
*F25D 27/00* (2006.01)
*F25D 23/02* (2006.01)

(52) U.S. Cl.
CPC ..... *F25D 27/00* (2013.01); *F25D 23/028* (2013.01); *F25D 2400/36* (2013.01)

(58) Field of Classification Search
None
See application file for complete search history.

(56) References Cited

U.S. PATENT DOCUMENTS 8,789,900 B2 7/2014 Laible et al.
2010/0313592 A1* 12/2010 Pae ..... F25D 23/02 62/449
2014/0232958 A1 8/2014 Venturas et al.
2014/0268657 A1 9/2014 Dunn et al.
2016/0195328 A1* 7/2016 Frommelt ..... F25D 27/005 362/92
2017/0108267 A1* 4/2017 Osbar ..... H05B 47/11
2021/0026056 A1* 1/2021 Park ..... G02B 6/0055
2021/0199367 A1* 7/2021 Kim ..... F25D 23/028
2021/0373717 A1* 12/2021 McClure ..... F25D 29/005
2023/0134292 A1* 5/2023 Hong ..... F21V 23/0435 362/92
2024/0027124 A1* 1/2024 Kim ..... F25D 27/00

FOREIGN PATENT DOCUMENTS

CN 103250018 8/2013
CN 107763947 3/2018
KR 101628364 6/2016
WO WO 2022/114493 6/2022

OTHER PUBLICATIONS

Extended European Search Report in European Appln. No. 23186780.5, mailed on Nov. 24, 2023, 7 pages.

* cited by examiner

*Primary Examiner* — Christopher E Dunay
(74) *Attorney, Agent, or Firm* — Fish & Richardson P.C.

(57) ABSTRACT

A home appliance includes: a cabinet defining a storage space, and a door configured to open and close the storage space. The door includes a door body, and a panel assembly disposed at the door body and defining a front surface of the door. The panel assembly includes a panel defining the front surface of the door, a lighting device having a size corresponding to a size of the panel and comprising a plurality of light sources configured to emit light toward the panel, and a separation portion provided between the panel and the lighting device, where the separation portion is configured to, based on being contacted with a rear surface of the panel, be spaced apart from the light source.

6 Claims, 25 Drawing Sheets

(a)

(b)

REFRIGERATOR AND HOME APPLIANCE

CROSS-REFERENCE TO RELATED APPLICATIONS

This application claims the benefit of Korean Patent Application No. 10-2022-0090919, filed on Jul. 22, 2022, and Korean Patent Application No. 10-2022-0146909, filed on Nov. 7, 2022. The disclosures of the prior applications are incorporated by reference in their entirety.

THE BACKGROUND

1. The Field

The present disclosure relates to a refrigerator and a home appliance.

2. Description of the Related Art

In general, home appliances are placed indoors, and may be arranged to harmonize with the surrounding space. In addition, in order to further improve the outer appearance of such a home appliance, a panel forming the outer appearance may be provided on the front surface of the home appliance.

Typically, structures for diversifying the front outer appearance of refrigerators are being developed in order to harmonize with the environment in which they are placed, surrounding furniture, or other home appliances, and this trend is being made across all home appliances.

In U.S. Pat. No. 8,789,900, a structure is disclosed in which a decoration panel for forming an outer appearance is mounted on the front surface of a refrigerator door, and the outer appearance of the front door thereof can be formed to suit the user's taste by being configured to detach the decoration panel.

However, in the refrigerator having such a structure, if the user wants to change the outer appearance thereof, the entire decoration panel must be separated and then replaced, and the decoration panel before replacement can no longer be used.

In order to solve this problem, in Chinese Patent No. 103250018, a refrigerator is disclosed in which a reflective layer and a transparent panel are provided on the front surface of the refrigerator door, and light emitting members having colors are mounted on both ends of the reflective layer so that the transparent panel can shine in a set color.

However, in such a structure, the entire front surface of the door cannot uniformly shine, and both ends where the light emitting member is disposed become dark, or the brightness is relatively dark in a portion located far from the light emitting member, and thus there is a problem of resulting in poor outer appearance quality.

THE SUMMARY

An object of an embodiment of the present disclosure is to provide a refrigerator and a home appliance in which the entire panel forming the front surface of a door can shine in a color set by a user.

An object of an embodiment of the present disclosure is to provide a refrigerator and a home appliance in which a color displayed through a front panel of a door can be changed when the panel is mounted.

An object of an embodiment of the present disclosure is to provide a refrigerator and a home appliance that allow a panel forming the front surface of a door to shine with uniform brightness.

An object of an embodiment of the present disclosure is to provide a refrigerator and a home appliance capable of outputting a screen set by a user through a front panel of a door.

A refrigerator and home appliance according to an embodiment of the present disclosure may include a cabinet having a storage space; and a door body opening and closing the cabinet, and a panel assembly detachably mounted to the door body, in which the panel assembly includes: a panel forming a front outer appearance of the door and transmits light; a lighting device provided behind the panel and emitting light toward the panel; and a back cover forming a rear surface of the panel assembly and shielding the lighting device from the rear side.

A home appliance according to an embodiment of the present disclosure includes a cabinet forming a storage space; a door opening and closing the cabinet; in which the door includes a door body, and a panel assembly mounted on the door body to form a front surface of the door, in which the panel assembly includes a panel forming the front surface; a lighting device having a size corresponding to that of the panel and having a plurality of light sources arranged thereon to emit light toward the panel; and a separation portion provided between the panel and the lighting device; and in which the separation portion maintains a state of being spaced apart from the light source in a state of being in contact with the rear surface of the panel.

The separation portion may include a front portion in contact with a rear surface of the panel; and a side portion extending from the front portion in a direction in which the lighting device is provided.

The panel assembly may have an air gap through which air flows is formed between the front portion of the separation portion and the lighting device.

The side portion may extend to at least a rear end of the lighting device.

The panel assembly may further include a support member for supporting the lighting device from the rear, in which the side portion of the separation portion is in contact with at least a portion of the support member.

The panel assembly may further include a back cover forming a rear surface, and in which the support member is disposed between the back cover and the lighting device.

The panel assembly may include a fixing member formed to contact at least a portion of the support member and a side surface of the separation portion.

The fixing member may include a first fixing member in contact with a side portion of the separation portion and a portion of the side surface of the support member; and a second fixing member bent at one end of the first fixing member and in contact with a rear surface of the support member.

The panel assembly may have a separation adjusting portion provided between the lighting device and the support member and adjusting a spacing between the lighting device and the separation portion.

The panel assembly may further include a fastening member inserted into the support member through the side surface of the separation portion.

The panel may include a diffusion agent that increases the diffusion of light emitted from the lighting device.

The panel may include a pattern layer having irregularities formed on a surface thereof.

The lighting device may include a base including at least one film layer; and a plurality of light sources disposed on the base.

An interval between adjacent light sources may be 4 to 8 mm.

The distance between the base end portion and the outermost light source may be arranged to be shorter than a distance between adjacent light sources located in the center portion of the base.

The distance between the base end portion and the outermost light source may be longer than a distance between adjacent light sources located in the central portion of the base.

A lighting PCB for controlling the operation of the light source may be provided at the lower end of the lighting device, and the lighting PCB may include a PCB connector electrically connected to a controller.

The color of a light provided by the lighting device may be changed to a color set according to an operating state of the home appliance or a user setting.

A refrigerators and a home appliance according to the proposed embodiment can expect the following effects.

In the refrigerator and home appliance according to the embodiment of the present disclosure, a lighting device is provided behind the panel, and a plurality of LEDs constituting the lighting device emit light of a set color toward the panel, and thus there is an advantage of changing the color of the front surface of the panel in various ways.

In particular, the plurality of LEDs are evenly distributed in the rear area of the panel, and all the LEDs emit light toward the rear surface of the panel so that the entire panel can shine in a desired color, and thus there is an advantage that the front outer appearance of the door, that is, the overall exterior color of the refrigerator and the home appliance can be exchanged.

The lighting device according to an embodiment of the present disclosure can be maintained at set intervals from the panel by a space keeping portion. Therefore, by forming an air gap between the lighting device and the panel, there is an advantage in that natural color and image expression is possible because light is more easily diffused.

In addition, as the plurality of LEDs emit light toward the rear surface of the panel, a screen output in the form of a picture, text, image, video, or the like can be displayed on the panel through a combination of the plurality of LEDs. Therefore, it is possible to configure the outer appearance in a form desired by the user, and there is an advantage in that various information can be provided through the screen output of the panel.

THE DETAILED DESCRIPTION

Hereinafter, specific embodiments of the present disclosure will be described in detail with drawings. However, the present disclosure cannot be said to be limited to the embodiments in which the spirit of the present disclosure is presented, and other degenerative disclosures or other embodiments included in the scope of the present disclosure can be easily suggested by adding, changing, or deleting other components.

Define direction before description. In an embodiment of the present disclosure, the direction toward the door may be defined as a front direction based on the cabinet illustrated in FIG. 1, the direction toward the cabinet may be defined as a rear direction based on the door, the direction toward the floor where the refrigerator is installed may be defined as a lower direction, and the direction away from the floor may be defined as a upper direction.

Figure 1:
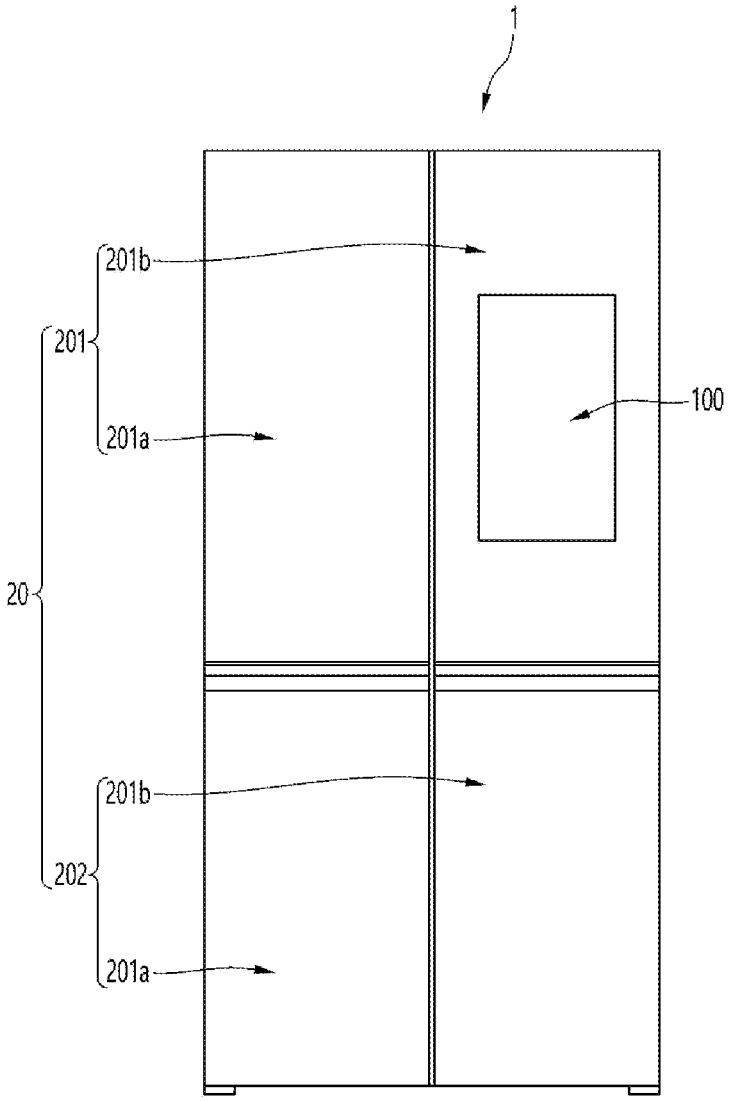
FIG. 1 is a front view illustrating a refrigerator according to a first embodiment of the present disclosure.
Figure 2:
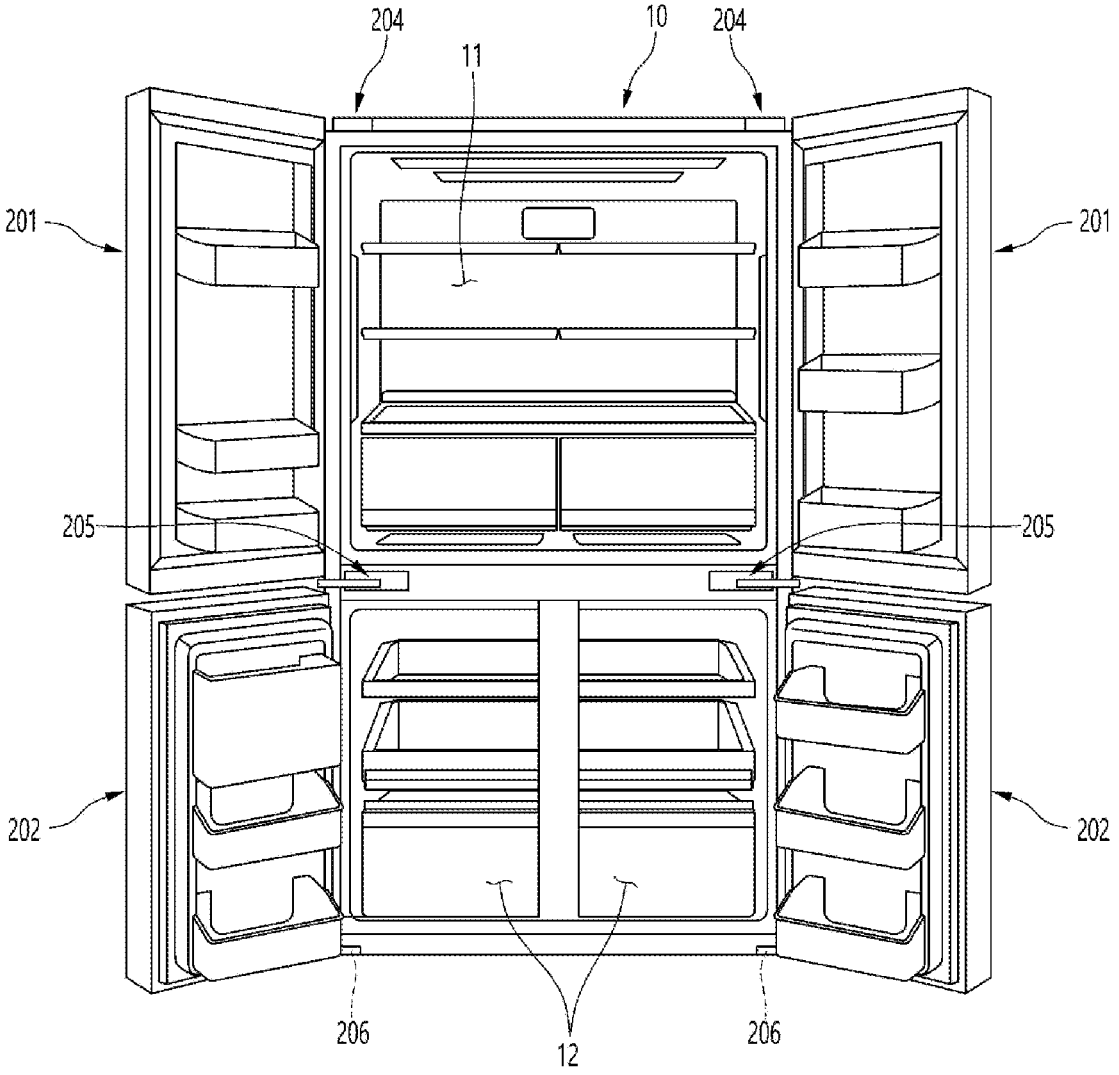
FIG. 2 is a front view illustrating a state where the door of the refrigerator is opened.

FIG. 1 is a front view illustrating a refrigerator according to a first embodiment of the present disclosure, and FIG. 2 is a front view illustrating a state where the door of the refrigerator is opened.

As illustrated, the outer appearance of the refrigerator 1 according to the embodiment of the present disclosure may be formed by a cabinet 10 forming a storage space and a door 20 opening and closing the storage space of the cabinet 10.

For example, the cabinet 10 may form a storage space divided in the vertical direction, with a refrigerating chamber 11 formed at an upper portion and a freezing chamber 12 formed at a lower portion. The refrigerating chamber 11 may be referred to as an upper storage space, and the freezing chamber 12 may be referred to as a lower storage space.

The door 20 may be configured to open and close the refrigerating chamber 11 and the freezing chamber 12, respectively. The door 20 may include a refrigerating chamber door 201 opening and closing the refrigerating chamber 11 and a freezing chamber door 202 opening and closing the freezing chamber 12. In addition, a pair of refrigerating chamber doors 201 may be disposed side by side on both left and right sides, and each refrigerating chamber door 201 may partially open and close the refrigerating chamber 11. In addition, a pair of freezing chamber doors 202 may be disposed side by side on both left and right sides, and may open and close the freezing chamber 12 divided into left and right sides, respectively. Since the refrigerating chamber door 201 is provided above the cabinet 10, the refrigerating chamber door 201 may be referred to as an upper door, and since the freezing chamber door 202 is provided below the cabinet 10, the freezing chamber door 202 may be referred to as a lower door.

The door 20 may be rotatably mounted on the cabinet 10 by being connected by hinge devices 204, 205, and 206, and the refrigerating chamber 11 and the freezing chamber 12 may be opened and closed by rotation, respectively.

In this embodiment, for convenience of description and understanding, a refrigerator having a structure in which the refrigerating chamber 11 is disposed at the upper side and the freezing chamber 12 is disposed at the lower side is described as an example, but the present disclosure is not limited to the shape of the refrigerator and may be applied to all types of refrigerators provided with doors.

Meanwhile, the door 20 forms the front outer appearance of the refrigerator 1 in a closed state, and may form the front outer appearance of the refrigerator 1 in a state where the refrigerator 1 is installed.

The door 20 may have a structure in which the front surface may selectively emit light, and may be configured to emit light in a set color or brightness. Therefore, the user can change the color or brightness of the front surface of the door 20 without separating or disassembling the door 20, and can change the overall outer appearance of the refrigerator 1.

Hereinafter, the structure of the door 20 will be described in detail with reference to the drawings. Further, in the embodiment of the present disclosure, the refrigerating chamber door 201 will be described as a standard, and other doors may also have the same structure with a difference only in the mounting position.

Figure 3:
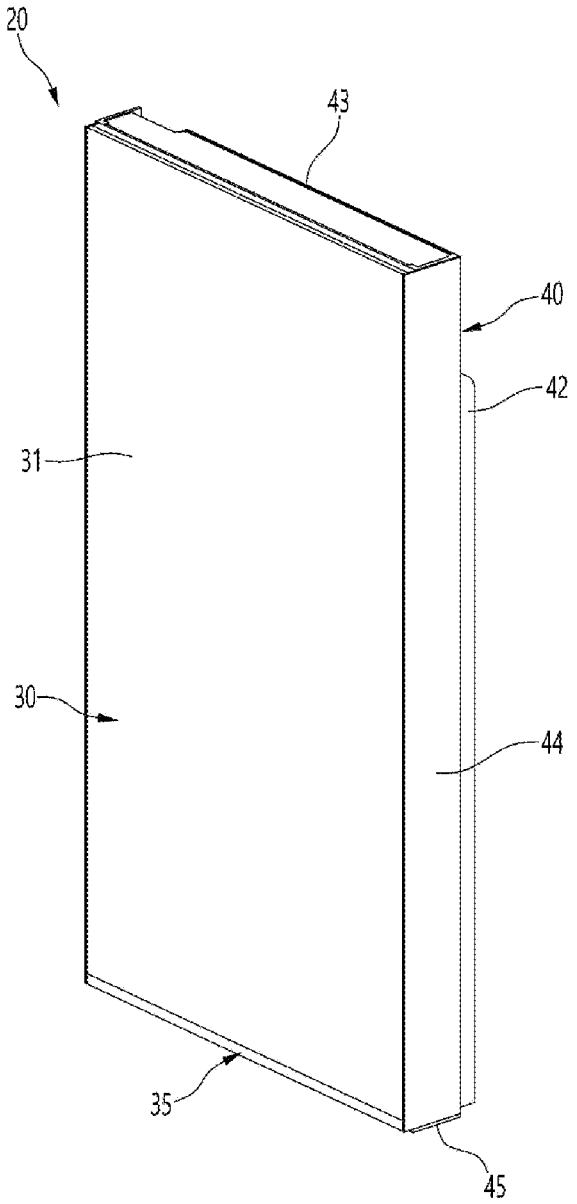
FIG. 3 is a perspective view illustrating the door.
Figure 4:
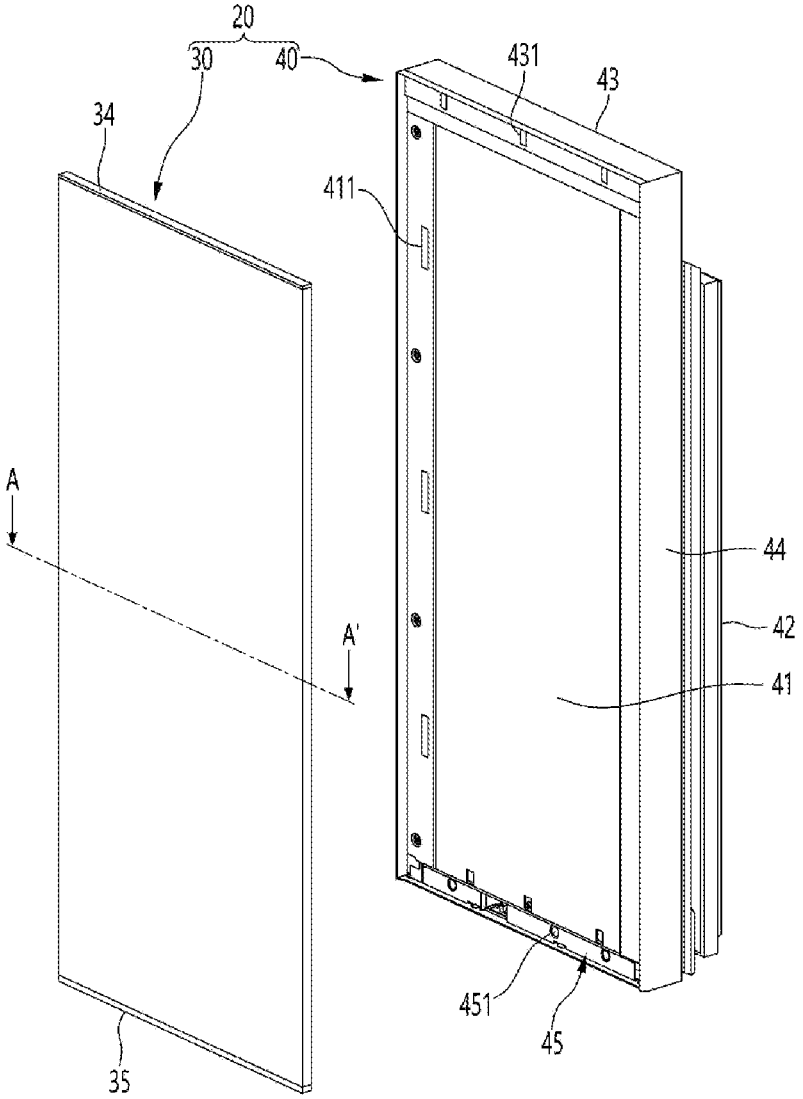
FIG. 4 is an exploded perspective view illustrating a state where a panel assembly, which is a main component of the door and a door body are separated.

FIG. 3 is a perspective view illustrating the door, and FIG. 4 is an exploded perspective view illustrating a state where a panel assembly, which is a main component of the door and a door body are separated.

As illustrated, the door 20 may include a door body 40 that forms the overall shape of the door 20 and opens and closes the storage space, and a panel assembly 30 that forms the front outer appearance of the door 20.

The door body 40 may include a body plate 41 forming a front surface and a door liner 42 forming a rear surface. In addition, the door body 40 may include side decorations 44 forming both left and right sides of the door body 21. The side decorations 44 may extend in the vertical direction, and the upper end may be coupled with the upper cap decoration 43 and the lower end may be coupled with the lower cap decoration 45. In addition, the door body 40 may further include an upper cap decoration 43 and a lower cap decoration 45 forming upper and lower surfaces of the door body 40.

In other words, the outer appearance of the door body 40 may be formed by the body plate 41, the door liner 42, the side decorations 44, the upper cap decoration 43, and the lower cap decoration 45. In addition, the space inside the door body 40 formed by coupling the body plate 41, the door liner 42, the side decorations 44, the upper cap decoration 43, and the lower cap decoration 45 is filled with insulating material 400.

In addition, a structure for mounting the panel assembly 30 may be provided on the front surface of the door body 40. In detail, an upper mounting portion 431 into which an upper protrusion 343 protruding from the rear surface of the panel assembly 30 is inserted may be formed on the front surface of the upper cap decoration 43. In addition, a lower mounting portion 451 into which a lower protrusion 353 protruding from the rear surface of the panel assembly 30 is inserted may be formed on the front surface of the lower cap decoration 45. In addition, a fixture 411 into which fixing members protruding rearward from left and right sides of the rear surface of the panel assembly 30 are inserted may be further formed on the front surface of the door body 40.

At least one of the upper protrusion 343, the lower protrusion 353, and a fixing member may be provided, and the panel assembly 30 may be detachable from the door body 40 in an assembled state.

The panel assembly 30 is formed in a plate shape, and may form the front outer appearance of the door 20 in a state of being mounted on the front surface of the door body 40. Since the panel assembly 30 forms the front outer appearance of the door 20, the panel assembly may be called a door panel, and since the panel assembly forms the front outer appearance of the refrigerator 1, the panel assembly may also be called an exterior panel.

In this way, the panel assembly 30 may have a structure that can be separated from the door body 40 and mounted thereon for service and maintenance.

The front surface of the panel assembly 30 is exposed forward while being mounted on the door body 40 and may form a substantial front outer appearance of the door 20. In other words, the color of the front outer appearance of the door 20 may be determined by the color of the front surface of the panel assembly 30. In addition, the entire front surface of the panel assembly 30 may be configured to shine in a color designated by the user, and in a state where the door 20 and the panel assembly 30 are mounted, the panel assembly is changed to various colors selected by the user, and thus the front color of the door 20 may be expressed in various ways. In addition, the panel assembly 30 may transmit information to the user in the form of a picture, text, image, or video through screen output.

Hereinafter, the structure of the panel assembly 30 will be described in detail with reference to drawings.

Figure 5:
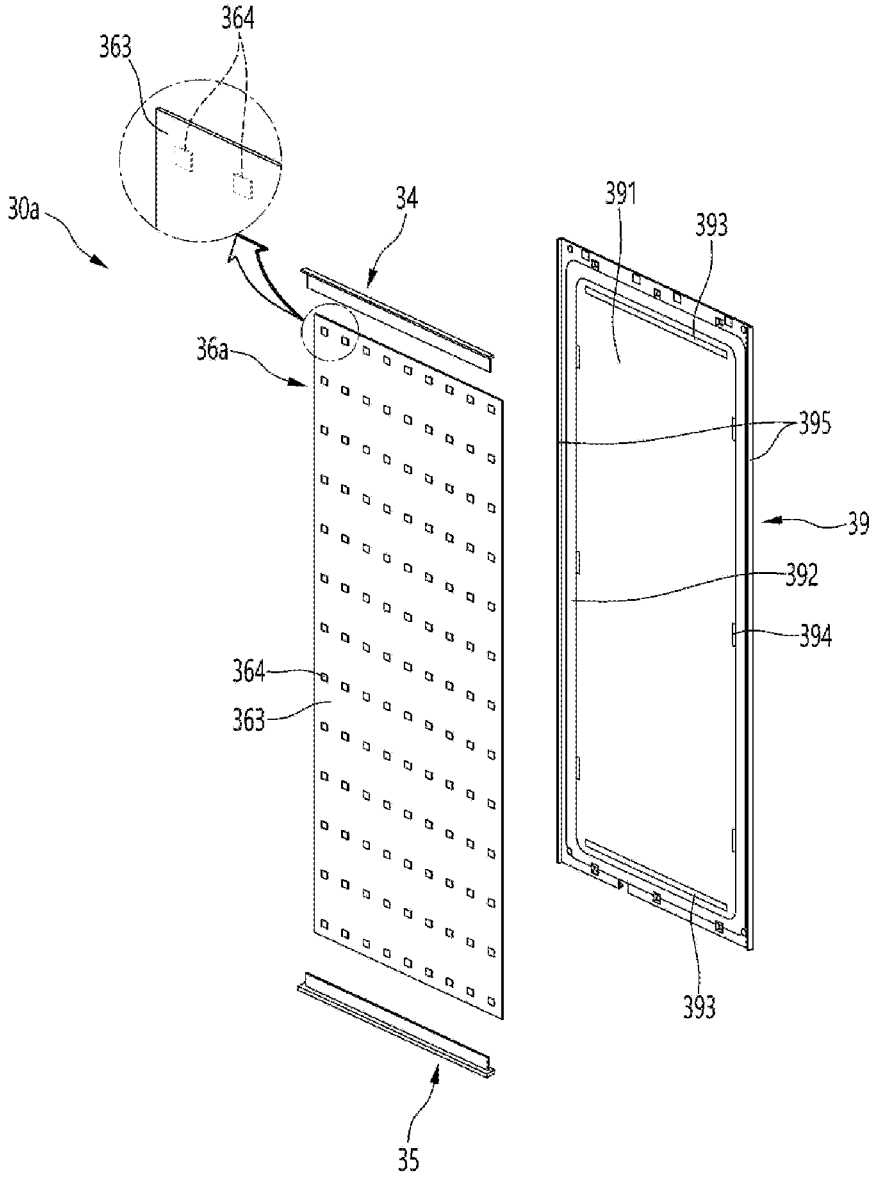
FIG. 5 is an exploded perspective view illustrating the panel assembly according to the first embodiment of the present disclosure.
Figure 6:
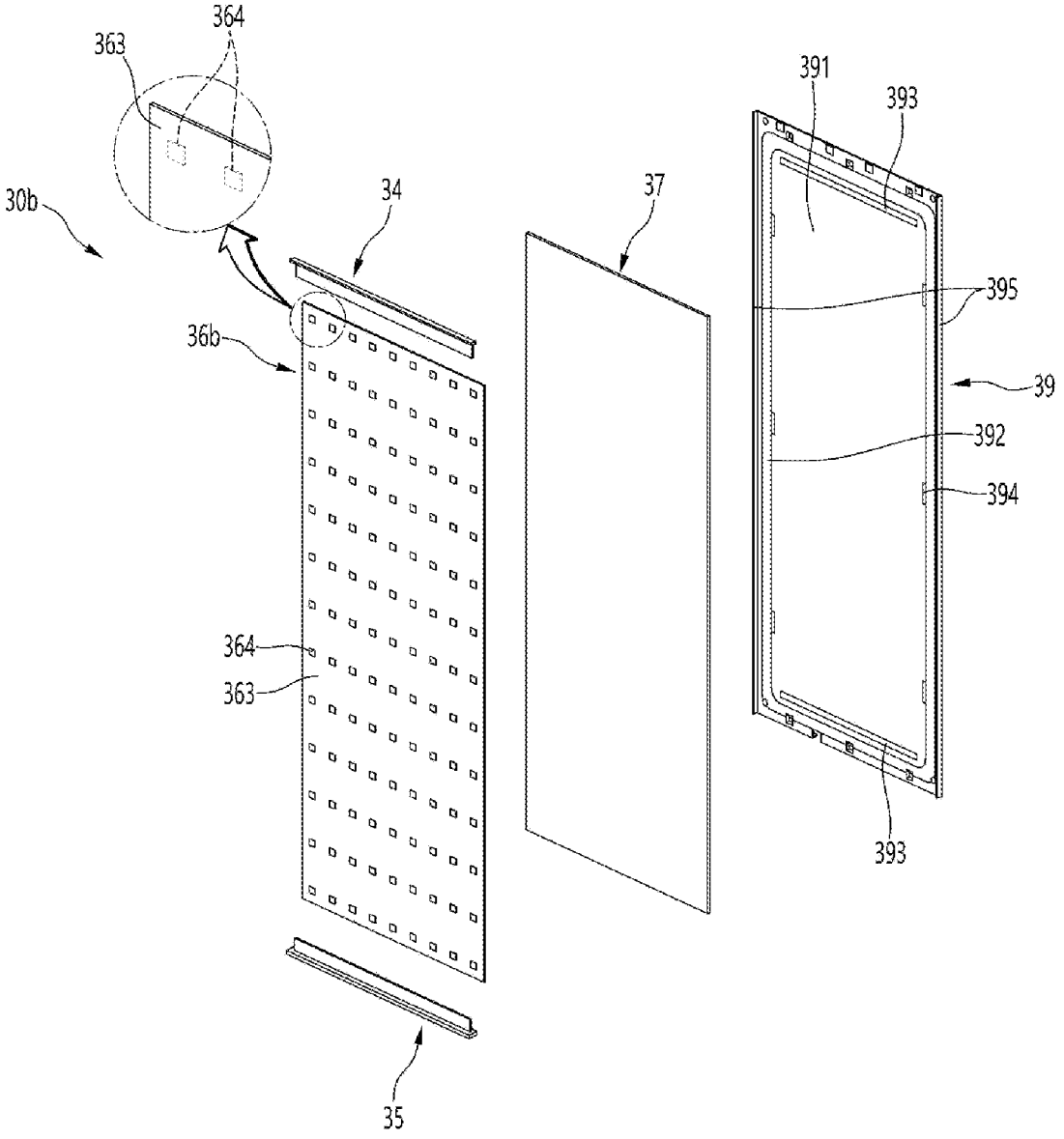
FIG. 6 is an exploded perspective view illustrating the panel assembly according to the second embodiment.
Figure 7:
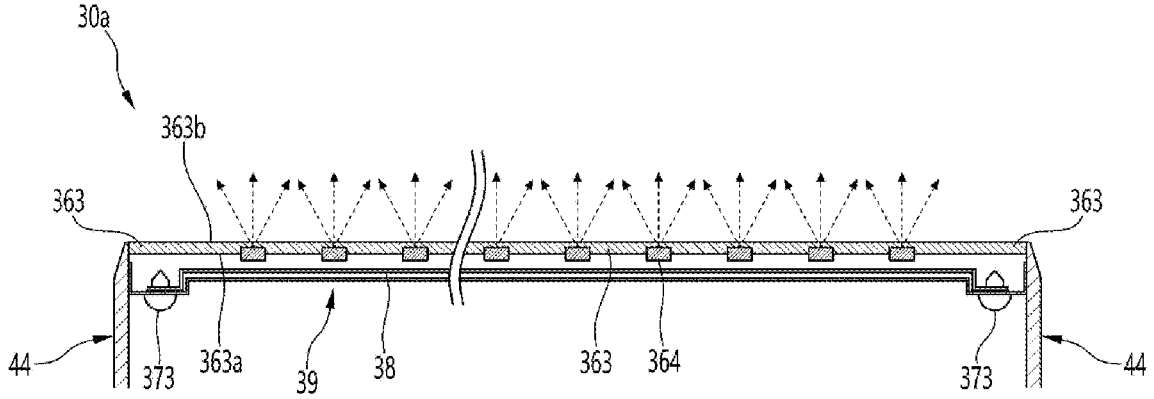
FIG. 7 is a cross-sectional view illustrating the panel assembly according to the first embodiment.

FIG. 5 is an exploded perspective view illustrating the panel assembly according to the first embodiment of the present disclosure, FIG. 6 is an exploded perspective view illustrating the panel assembly according to the second embodiment, and FIG. 7 is a cross-sectional view illustrating the panel assembly according to the first embodiment.

The panel assembly 30*a* according to the first embodiment of the present disclosure may include a lighting device 36 for emitting light on the front side and a back cover 39 supporting the lighting device 36 from the rear, and forming the rear outer appearance by the panel assembly 30.

In addition, both side surfaces of the lighting device 36 and the back cover 39 may be fixed by side decorations 44 forming both side surfaces of the door 20.

The panel assembly 30*a* may include an upper bracket 34 forming an upper surface of the panel assembly 30. The panel assembly 30*a* may further include a lower bracket 35 forming a lower surface of the panel assembly 30*a*.

In addition, the upper end portion of the lighting device 36 may be maintained in a fixed state by the upper bracket 34. In addition, the lower end portion of the lighting device 36 may be maintained in a fixed state by the lower bracket 35.

The back cover 39 is formed in a plate shape of a metal material and may form a rear surface of the panel assembly 30*a*. The back cover 39 may include a cover protrusion 391 at the center of the back cover 39 and a cover circumferential portion 392 formed along the circumference of the cover protrusion 391, and the cover protrusion 391 and the cover circumferential portion 392 may be formed by forming.

The cover protrusion 391 may support the rear surface of the lighting device 36. In addition, upper and lower ends of the cover circumferential portion 392 may be coupled to the upper bracket 34 and the lower bracket 34. For example, a screw may be fastened to the back cover 39 to be coupled to the upper bracket 34 and the lower bracket 35.

Meanwhile, the lighting device 36 is provided with a plurality of LEDs 364 for emitting light to shine brightly the color of the front surface of the door and can be configured in various ways.

For example, the lighting device 36 may include a plate-shaped substrate 361 and a plurality of LEDs 364 disposed on the front surface of the substrate 361.

At this time, the substrate 361 may be configured in various forms in which the LED 364 can be mounted and supported. For example, the substrate 361 may be formed in a rectangular plate shape. Of course, the substrate 361 may be divided into a plurality of pieces, and the divided substrates may be assembled to constitute the entire lighting device 36.

A surface on which a plurality of LEDs 364 are arranged at regular intervals may be formed on the substrate 361 to illuminate the entire area of the panel 31.

The LED 364 is configured to emit light of various colors. For example, the LED 364 may be composed of an RGB LED (Red Green Blue light emitting diode). In addition, the LED 364 may be composed of a small-sized micro LED. A plurality of the LEDs 364 may be spaced apart at set intervals, and the plurality of LEDs 364 may be arranged at equal intervals so that the panel 31 shines with uniform brightness and does not generate shadows.

Of course, if light of various colors can be emitted, a light source other than the LED 364 may be mounted on the substrate. Accordingly, the LED 364 may also be referred to as a light source.

As another example, the lighting device 36 may include a base 363 and a plurality of LEDs 364 mounted on the base 363. The base 363 may be formed of one or more sheets and may be configured in the form of a film.

In detail, the base 363 may be formed of a polyethylene terephthalate (PET) film material, and forms a surface on which the LED 364 can be disposed. The base 363 may be formed in a size corresponding to or slightly smaller than the size of the panel 31 and may be configured to illuminate the entire door 20 by light emitted from the LED 364.

In this case, the LED 364 may be an R.G.B LED. In addition, a driver IC may be provided on one side of the LED 364. The driver IC is configured to drive the LED 364 by providing driving signals and data.

This LED 364 may be formed to have lengths in the vertical direction and the left and right direction of about 2 mm.

A capacity may be further provided on one side of the LED 364.

Meanwhile, the base 363 may be composed of a plurality of layers. For example, the base 363 may include a first layer 363*a* on which the plurality of LEDs 364 are disposed, and a second layer 363*b* disposed on the front surface of the first layer 363*a* to shield the LEDs 364.

For example, the first layer 363*a* may be formed of a PT material. The second layer 363*b* may be formed of a silicon material. An electrode connected to the LED 364 may be disposed between the first layer 363*a* and the second layer 363*b*.

The second layer 363*b* is configured to shield all of the plurality of LEDs 364 and at least a portion thereof may be formed to overlap the first layer 363*a*. In addition, the second layer 363*b* may be formed of a transparent material so that the light emitted from the LED 364 is transmitted and directed toward the panel 31. In this case, the second layer 363*b* may be a diffusion sheet that diffuses light emitted from the LED 364.

In addition, the base 363 may include an electrode circuit 363*d* at a lower end of the light source 364. The electrode circuit 363*d* may be disposed on the first layer 363*a*. The electrode circuit 363*d* transfers electricity or signals from a power supply or controller to the light source 364, and a current sufficient for light emission of the light source 364 can flow through the electrode circuit 363*d*. Since the electrode circuit 363*d* maintains high clarity and transparency, the electrode circuit can be provided on the upper surface of the base 363 to maintain transparency.

A third layer 363*c* made of an adhesive may be formed on the rear surface of the base 363 to be adhered to the mounting member 37 and the like. The lighting device 36 may be fixed to the panel assembly 30 by the third layer 363*c*.

The panel assembly 30*b* according to the second embodiment of the present disclosure may further include a lighting device 36 for emitting light to the front surface, a back cover 39 for forming a rear outer appearance of the panel assembly 30, and a mounting member 37 in contact with the rear surface of the lighting device 36.

The mounting member 37 may be formed in the form of a plastic injection molding or a metal plate. The lighting device 36 may be fixed to the back cover 39 while being mounted on the mounting member 37. In a state where the back cover 39 is mounted on the door body 40, it may be foamed to fill the insulating material. In addition, after foaming, the lighting device 36 may be fixed to the back cover 39 while being mounted on the mounting member 37 in a state where the insulating material is filled. Therefore, it is possible to prevent the LED from being damaged in the process of foaming the insulating material.

In addition, the mounting member 37 may be composed of any one of polybutylene terephthalate, polyethylene terephthalate, polysulfone, polyether, polyether imide, and polyarylate (PAR).

In addition, the mounting member 37 may be formed of a metal material including any one of aluminum, copper, gold, silver and nickel having excellent thermal conductivity. Through this, it may serve as a heat sink to dissipate heat generated from the LED.

Meanwhile, the side decorations 44 may be formed in a structure that extends to the front end of the lighting device 36 and surrounds both sides of the lighting device 36. Accordingly, the lighting device 36 may be fixed by the side decorations 44.

In this case, the side decorations 44 may be formed to have a thinner horizontal thickness as the side decorations extend toward the front of the lighting device 36. Accordingly, when looking at the door from the front, the exposed portion of the side decor 44 can be minimized.

With this structure, the panel assembly may be configured such that the entire door 20 shines in a set color by the light emitted from the LED 364.

Figure 8:
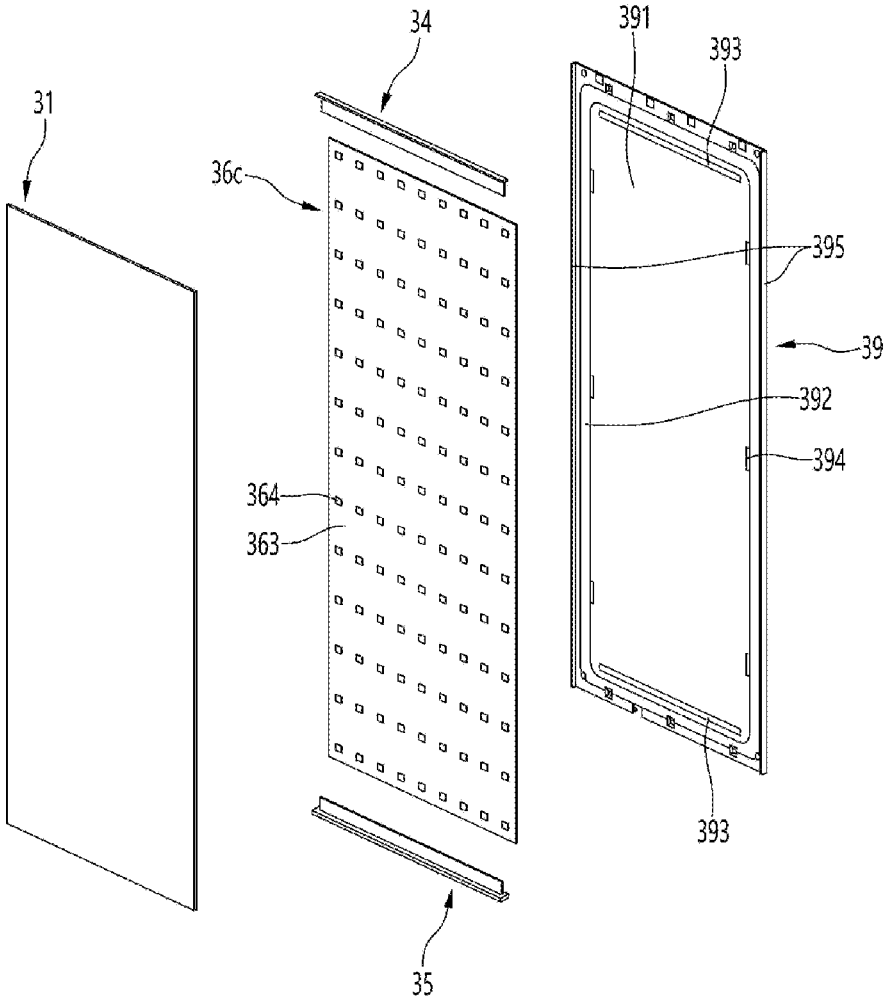
FIG. 8 is an exploded perspective view illustrating the panel assembly according to the third embodiment.
Figure 9:
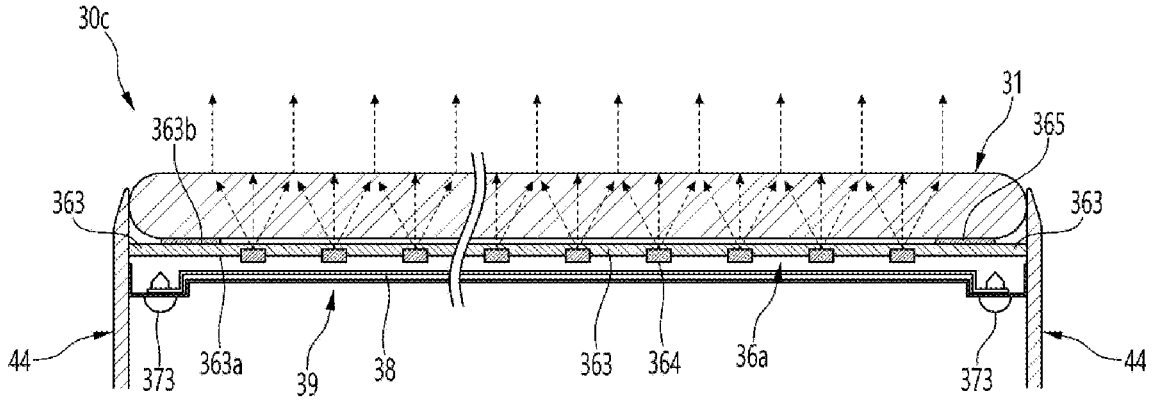
FIG. 9 is a cross-sectional view illustrating a panel assembly according to a third embodiment.

FIG. 8 is an exploded perspective view illustrating the panel assembly according to the third embodiment, and FIG. 9 is a cross-sectional view illustrating a panel assembly according to a third embodiment.

The panel assembly 30*c* according to the third embodiment of the present disclosure may further include a panel 31 provided in front of the lighting device 36 to form a front outer appearance of the door 20.

In detail, the panel 31 may be formed in a rectangular plate shape and may be formed of a transparent material capable of transmitting light. For example, the panel 31 may be formed of a glass material such as blue glass, white glass, or deposited glass, or another material capable of transmitting light such as ABS, PMMA, or PC. In all embodiments of the present disclosure, "transparency" and "transmission" may be defined as a state where a set color may appear through the panel 31 through the passage of the light.

In addition, the panel 31 may be formed to have a color. The panel 31 may be configured such that the light emitted from the lighting device 36 provided at the rear of the panel 31 is transmitted, but components at the rear of the panel 31 are not illuminated.

The panel 31 may correspond to or be larger than the size of the lighting device 36.

In addition, the panel 31 and the lighting device 36 may be firmly mounted to each other by means of an adhesive member 365. The adhesive member 365 may be formed along an edge portion of the panel 31 or the lighting device 36.

In this case, the side decorations 44 may further extend to both side ends of the panel 31. In other words, the side decorations 44 may contact both side surfaces of the lighting device 36 and may extend to both sides of the panel 31.

In addition, the side decorations 44 may have a thinner horizontal thickness as it extends from the rear end to the front end of the panel 31.

The light emitted from the LED 364 may pass through the panel 31 and cause the front surface of the door to shine brightly in a set color.

Figure 10:
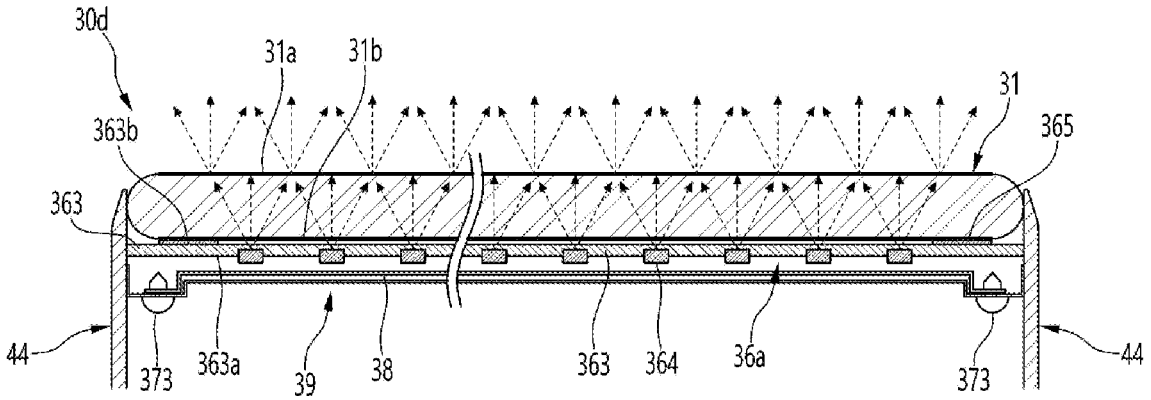
FIG. 10 is a cross-sectional view illustrating a panel assembly according to a fourth embodiment.

FIG. 10 is a cross-sectional view illustrating a panel assembly according to a fourth embodiment.

Meanwhile, the panel 31 of the panel assembly 30*d* may be processed to further increase the diffusion of the light emitted from the LED 364.

For example, the panel 31 may include an additive material such as a diffusion agent for diffusing light so that the light passing through the panel 31 is diffused and uniformly shines on the front surface of the door 20.

For example, at least one selected from titanium oxide, barium titanate, aluminum oxide, silicon oxide, zinc oxide, a metal piece, or a phosphor may be used as the diffusion agent.

As another example, the surface of the panel 31 may include pattern layers 31*a* and 31*b* in which fine patterns are formed. By the pattern layers 31*a* and 31*b*, the surface of the panel 31 is formed as an irregularity shape. When a fine pattern is formed on the panel 31, the light reflected inside the panel 31 can be extracted to the outside by total internal reflection caused by the surface of the panel 31 being flat, and thus the dispersion of the light emitted from the surface of the panel 31 can be further expanded. The shape and arrangement of these fine patterns may be configured in various ways.

The pattern layers 31*a* and 31*b* may be formed on the front or rear surfaces of the panel 31 without being limited thereto. Of course, the pattern layers 31*a* and 31*b* may be formed on both the front and rear surfaces of the panel 31, if necessary.

The pattern layers 31*a* and 31*b* may be made of, for example, satin glass, chemically etched surface-treated glass, and translucent glass. With this satin glass method, the light diffusion can be further increased by adjusting the gloss or transmittance and surface roughness.

Alternatively, fine patterns may be formed on the pattern layers 31*a* and 31*b* by, for example, an imprinting method. Accordingly, irreguralities are formed on the surface of the panel 31, and light passing through the panel 31 can be diffused.

When the light source 364 arranged in the lighting device 36 is insufficiently diffused, when the door 20 is viewed from the front, the light source 364 may appear prominent in a dot shape.

As another example, the panel 31 may include a printed layer having a set color. The printing layer may be formed to prevent the light emitted from the light source 364 from appearing prominently in a dot shape. For example, the printing layer may be printed in white color. In this case, light emitted from the light source 364 may be scattered and dispersed while passing through the panel 31.

Meanwhile, if the dispersion of the light emitted from the surface of the panel 31 is further expanded in this way, when the door 20 is viewed from the front, the boundary of the light source 364 appears blurry, enabling natural color and image expression.

As another example, a diffusion sheet may be provided on the front or rear surface of the panel 31 to increase the diffusion of the light emitted from the LED 364. Such a diffusion sheet may be configured in the form of a film coated with a light diffusion agent.

As another example, a separate auxiliary panel 32 may be further included to increase the diffusion of light emitted from the LED 364. The auxiliary panel 31 may be provided between the panel 31 and the lighting device 36. In addition, the auxiliary panel 31 may be formed of a plastic injection molding material or a glass material.

As described above, the auxiliary panel 32 may include an additive material such as a diffusion agent or may have a fine pattern formed thereon.

Figure 11:
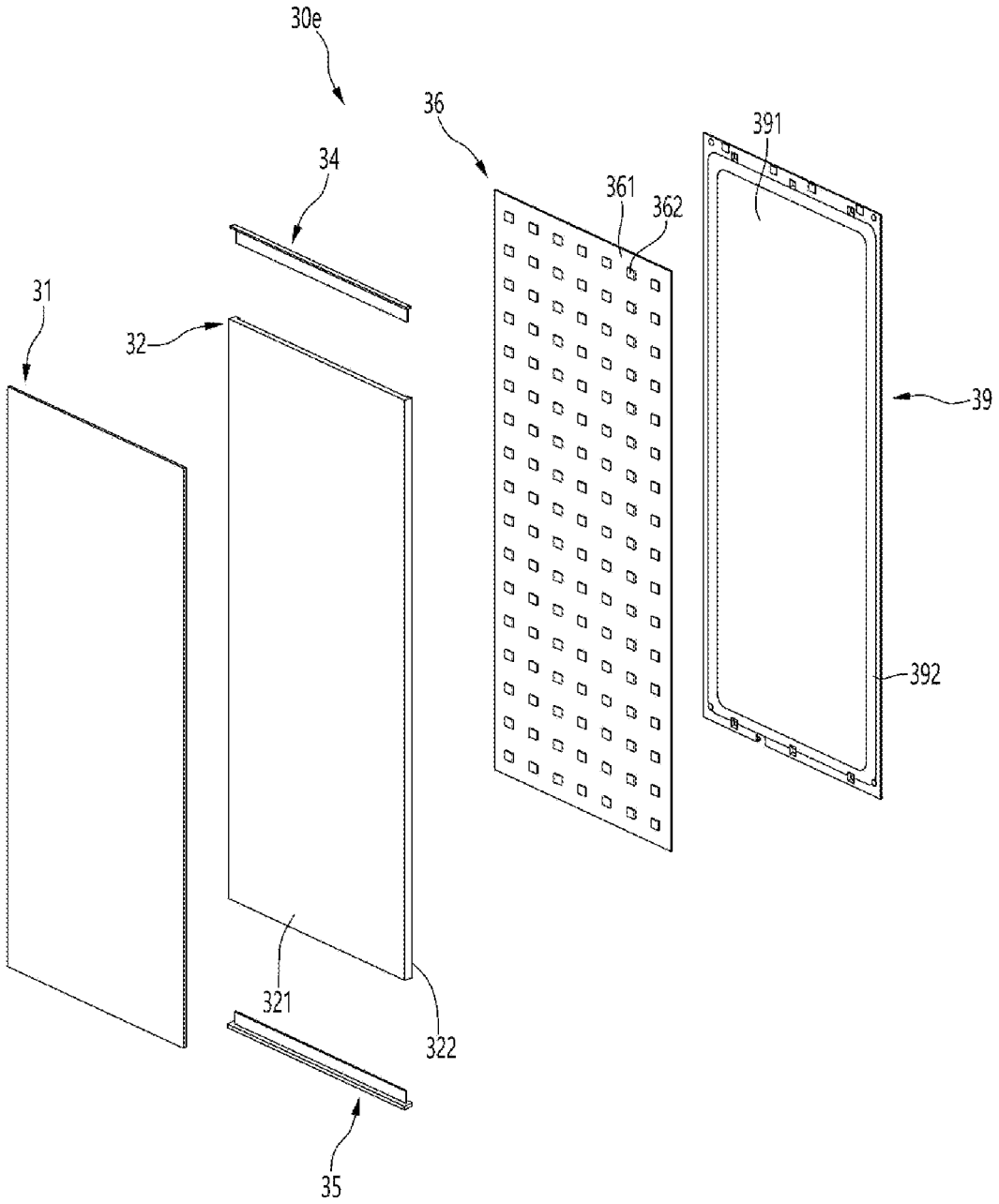
FIG. 11 is an exploded perspective view illustrating a panel assembly according to a fifth embodiment.
Figure 12:
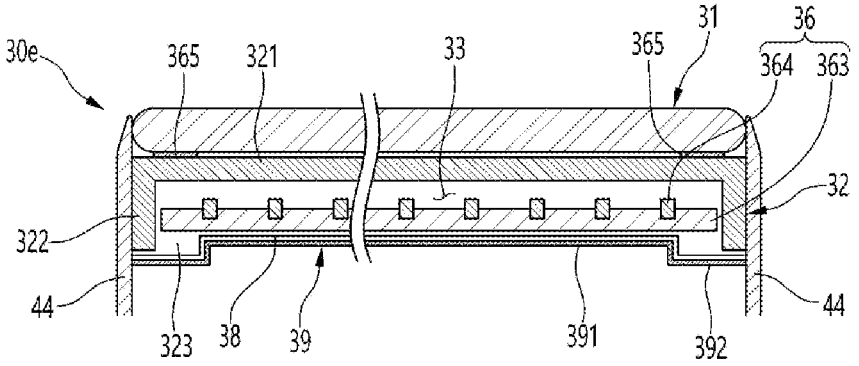
FIG. 12 is a cross-sectional view illustrating a panel assembly according to a fifth embodiment.

FIG. 11 is an exploded perspective view illustrating a panel assembly according to a fifth embodiment, and FIG.

12 is a cross-sectional view illustrating a panel assembly according to a fifth embodiment.

The panel assembly 30*e* according to the fifth embodiment of the present disclosure includes a panel 31 that forms the front outer appearance of the door and transmits light, a lighting device 36 provided behind the panel and emitting light toward the panel 31, and a separation portion 32 provided between the panel 31 and the lighting device 36 to form an air gap between the lighting device 36 and the panel 31.

In addition, the panel assembly 30*e* may include a back cover 39 that shields the lighting device 36 from the rear.

The separation portion 32 may be provided between the panel 31 and the lighting device 36. The separation portion 32 may be fixedly mounted on the rear surface of the panel 31. For example, the separation portion 32 may be fixed to the rear surface of the panel 31 with an adhesive or the like.

The separation portion 32 may include a plate-shaped front portion 321 and side portions 322 protruding rearward from both left and right side ends of the front portion 321.

The separation portion 32 may further include a rear portion bent at the rear end of the side portion 322.

The front portion 321 may be disposed between the panel 31 and the lighting device 36, and the front portion may contact the panel 31. In addition, the side portion 322 may extend to the rear end of the lighting device 36.

A distance at which the side portion 322 extends from the rear end of the panel 31 to the rear end of the lighting device 36 may be formed to be longer than the length of the lighting device 36 in the front and rear direction. Therefore, when the separation portion 32 is disposed between the panel 31 and the lighting device 36 in a state of being in contact with the panel 31, the panel 31 and the lighting device 36 may be spaced at set intervals.

In addition, a rear surface of the side portion 322 may come into contact with the back cover 39. The rear surface of the side portion 322 may have a structure fixed to the back cover 39 with an adhesive or the like.

With this structure, an air gap may be formed between the panel 31 and the lighting device 36.

In other words, the rear surface of the front portion 321 and the light source 364 may be spaced apart from each other by a set interval.

By forming an air gap between the lighting device 36 and the panel 31, the diffusion of the light emitted from the light source can be expanded. In other words, an angle at which light emitted from a light source is diffused can be increased by the distance spaced by the air gap. Therefore, when looking at the door from the front, it is possible to prevent the light emitted by the light source 364 from appearing prominently in a dot shape. Accordingly, there is an advantage in expressing more natural colors and images on the front surface of the door.

In addition, the air gap 33 formed by the separation portion 32 can prevent the lighting device 36 from being damaged due to humidity caused by a temperature difference between the lighting device 36 and the panel 31. In detail, one side of the panel assembly 30 may have a structure in which air is circulated through an opening. Through this, humidity generated between the air gaps 33 may be removed.

In addition, heat generated in the lighting device 36 can be released to the outside through the air gap 33, and thus the temperature of the lighting device 36 can be prevented from excessively rising.

Meanwhile, the side decorations 44 may be formed in a structure surrounding the side portion 322. In other words, the side decorations 44 extends from the rear end of the side portion 322 to the panel 31 to fix both sides of the separation portion 32.

Figure 13:
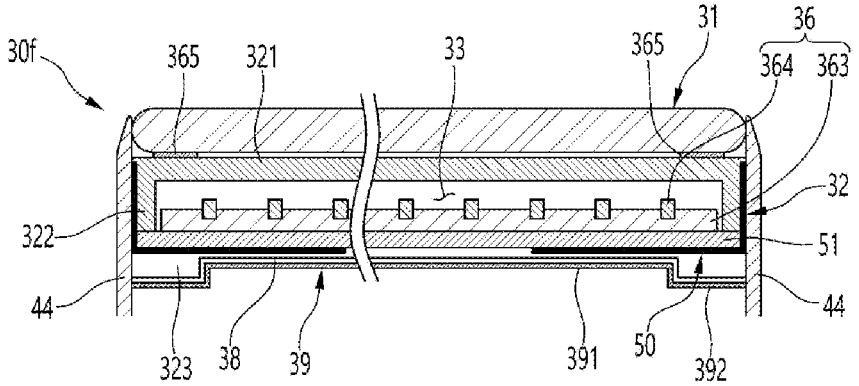
FIG. 13 is a cross-sectional view illustrating a panel assembly according to a sixth embodiment.

FIG. 13 is a cross-sectional view illustrating a panel assembly according to a sixth embodiment.

The panel assembly 30*f* according to the fifth embodiment of the present disclosure includes a panel 31 that forms the front outer appearance of the door and transmits light, a lighting device 36 provided behind the panel and emitting light toward the panel 31, and a separation portion 32 provided between the panel 31 and the lighting device 36 to form an air gap between the lighting device 36 and the panel 31.

In addition, the panel assembly 30*f* may include a back cover 39 that shields the lighting device 36 from the rear.

The separation portion 32 may be provided identically to the separation portion 32 provided in the panel assembly 30*f* according to the fifth embodiment described above. In other words, the separation portion 32 may include a plate-shaped front portion 321 and side portions 322 protruding rearward from both left and right side ends of the front portion 321.

The front portion 321 may be disposed between the panel 31 and the lighting device 36, and the front portion may contact the panel 31. In addition, the side portion 322 may extend to the rear end of the lighting device 36.

A distance at which the side portion 322 extends from the rear end of the panel 31 to the rear end of the lighting device 36 may be formed to be longer than the length of the lighting device 36 in the front and rear direction. Therefore, when the separation portion 32 is disposed between the panel 31 and the lighting device 36 in a state of being in contact with the panel 31, the panel 31 and the lighting device 36 may be spaced at set intervals.

The panel assembly 30*f* according to the sixth embodiment may further include a support member 51 supporting the lighting device 36 from the rear. The support member 51 may be formed in contact with the rear surface of the lighting device 36. In addition, the support member 51 may be formed to contact at least a portion of the rear surface of the separation portion 32.

The length of the support member 51 in the left and right, that is, horizontal direction may be formed to corresponding to a length in the left and right, that is, horizontal direction of the lighting device 36 and the separation portion 32 in a state where the lighting device 36 and the separation portion 32 are mounted. The support member 51 may be provided between the lighting device 36 and the back cover 39.

In addition, the panel assembly 30 according to the sixth embodiment may further include a fixing member 50 formed to surround at least a portion of the separation portion 32 and the support member 51. The fixing member 50 may be formed of, for example, a metal material. The fixing member 50 may include a first fixing member 501 formed to contact the side portion 322 of the separation portion 32 and a portion of the side surface of the support member 51, and a second fixing member 502 formed by bending to one side from the first fixing member 501.

The first fixing member 501 and the second fixing member 502 may be integrally formed. In addition, the second fixing member 502 may be formed to contact at least a portion of the rear surface of the support member 51.

The fixing member 50 may be provided as a pair behind the lighting device 36. In addition, the pair of fixing members 50 may be spaced apart from each other at intervals set in the left and right, that is, horizontal direction.

In addition, the side portion 322 of the separation portion 32 may further include a mounting groove provided to allow the fixing member 50 to be inserted.

The fixing member 50 is provided on both sides of the separation portion 32 to prevent the lighting device 36 from leaving its aligned position due to an external impact. In addition, the fixing member 50 fixes the position of the lighting device 36 so that the air gap formed by the separation portion 32 can be maintained.

With this structure, the aligned position of the lighting device 36 and the separation portion 32 can be fixed.

By forming an air gap between the lighting device 36 and the panel 31, the diffusion of the light emitted from the light source can be expanded. In other words, an angle at which light emitted from a light source is diffused can be increased by the distance spaced by the air gap. Therefore, when looking at the door from the front, it is possible to prevent the light emitted by the light source 364 from appearing prominently in a dot shape. Accordingly, there is an advantage in expressing more natural colors and images on the front surface of the door.

Figure 14:
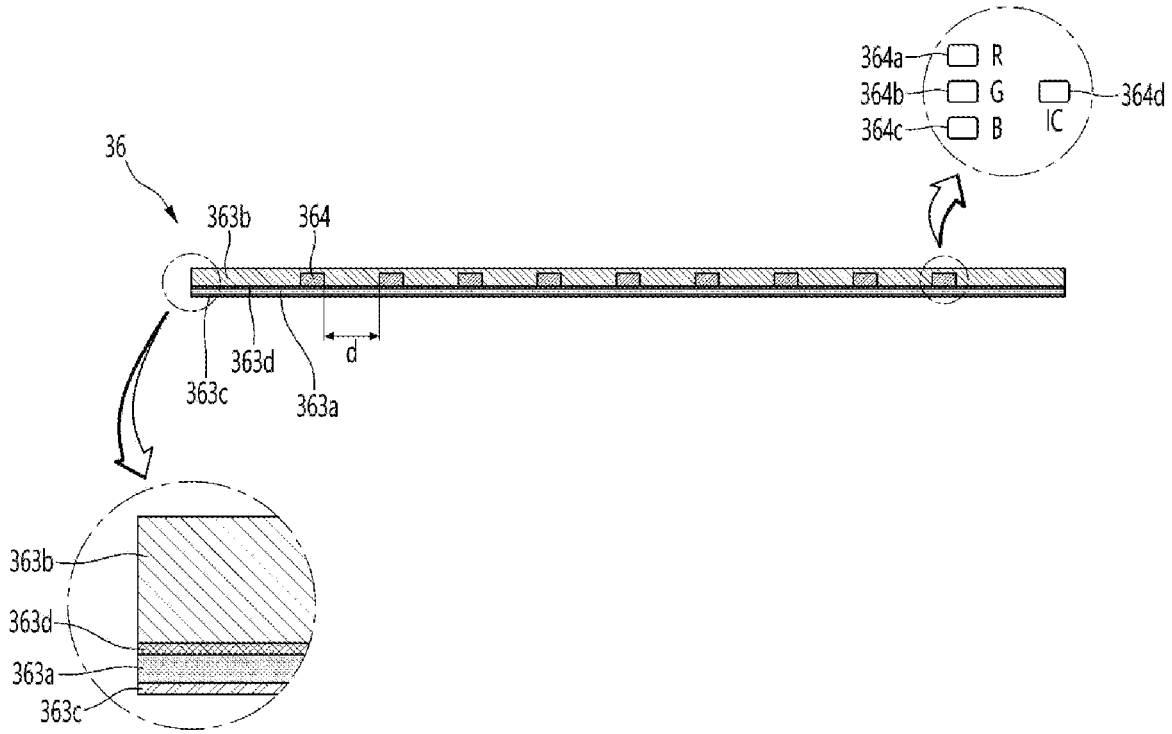
FIG. 14 is a cross-sectional view illustrating the lighting device according to the first embodiment.

FIG. 14 is a cross-sectional view illustrating the lighting device according to the first embodiment.

The lighting device 36 according to the first embodiment of the present disclosure includes a base 363 on which the light sources 364 are arranged. A plurality of light sources 364 may be arranged on the base 363 at intervals set in vertical and left and light directions. For example, the light sources 364 may be arranged in a matrix form on the base 363.

Each of the light sources 364 may include R, G, and B light sources 364*a*, 364*b*, and 364*c* and an integrated circuit (IC) 364*d*.

At this time, among the light sources 364, the distance d1 between adjacent light sources 364 in the left and right directions, that is, the pitch of the light sources 364 may be 4 to 8 mm, preferably 6 mm.

More specifically, a refrigerator according to an embodiment of the present disclosure may include a pair of left and right upper doors and a pair of left and right lower doors. In this case, the length of the pair of left and right widths, that is, the length in the left and right, that is, horizontal direction of the refrigerator may be 850 to 900 mm, or approximately 890 mm. In addition, the length of the refrigerator in the vertical direction may be 1700 to 1900 mm, approximately 1800 mm. At this time, when the pitch of the light source is 6 mm, it may be formed with 140 to 150 Pixels, approximately 148 Pixels in the left and right horizontal directions, and may be formed with 250 to 320 Pixels, approximately 301 Pixels in the up and down, that is, vertical direction.

In this case, when the user looks at the door from the front, natural colors and images can be expressed even if colors, images or letters are expressed on the front surface of the door by the lighting device 36.

Meanwhile, the length of the air gap in the front and rear direction may be determined by the pitch of the light source. In detail, the larger the pitch value, the longer the air gap is formed in the front and rear direction.

In detail, as the pitch value decreases, the number of light sources 364 disposed in a limited space of the lighting device 36 may increase. In addition, as the number of the light sources 364 increases, the pixel value increases, so that images, letters, or figures implemented in the door 20 can be expressed in more detail. However, as the pitch value of the light sources 364 decreases, the light sources 364 may appear prominent from the front of the door 20 and the manufacturing cost of the lighting device 36 increases. In addition, in order to prevent the light source 364 from appearing prominently, the length in the front and rear direction where the air gap is formed is increased, so that the thickness of the door 20 can finally be increased.

In addition, as the pitch value increases, the number of light sources 364 disposed in a limited space of the lighting device 36 may decrease. In addition, as the number of the light sources 364 decreases, the pixel value decreases, so that images, letters, or figures implemented in the door 20 may be expressed in a coarse manner. However, as the pitch value of the light sources 364 increases, the length of the required air gap in the front and rear direction becomes shorter, so that the thickness of the door 20 can be formed slim.

Accordingly, in the lighting device 36 according to the first embodiment of the present disclosure, the pitch of the light sources 364 may be set to 6 mm. In this case, when viewed from the front of the door, natural color and image can be implemented without the light source 364 becoming prominent, and the thickness of the door 20 can be formed slim.

For example, in the lighting device 36 according to the first embodiment, the light sources 364 may be arranged at regular intervals in the left and right, that is, horizontal directions and up and down, that is, vertical directions. In this case, the pitch of the light sources 364 may be 6 mm, but is not limited thereto.

Figure 15:
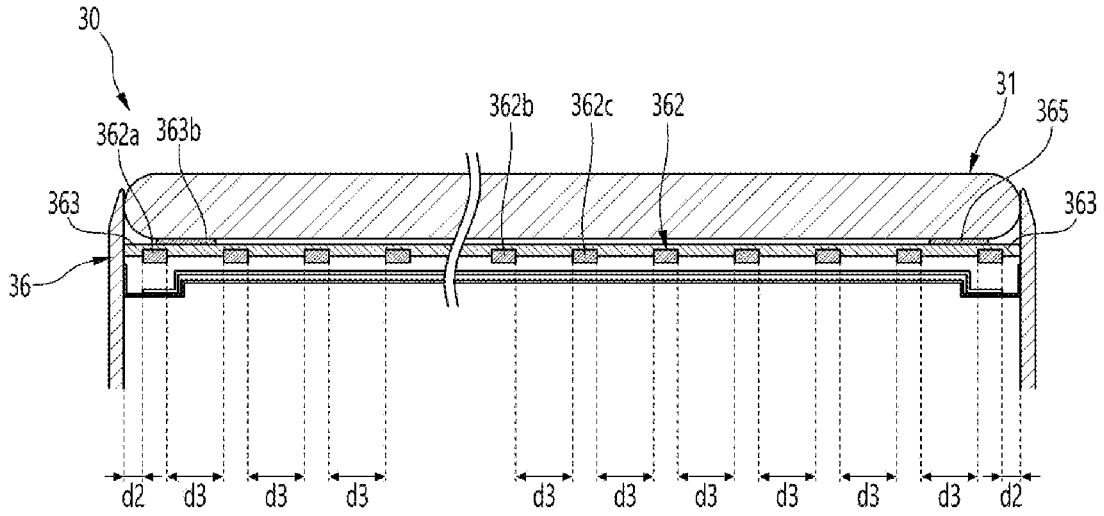
FIG. 15 is a cross-sectional view illustrating a lighting device according to a second embodiment.
Figure 15:
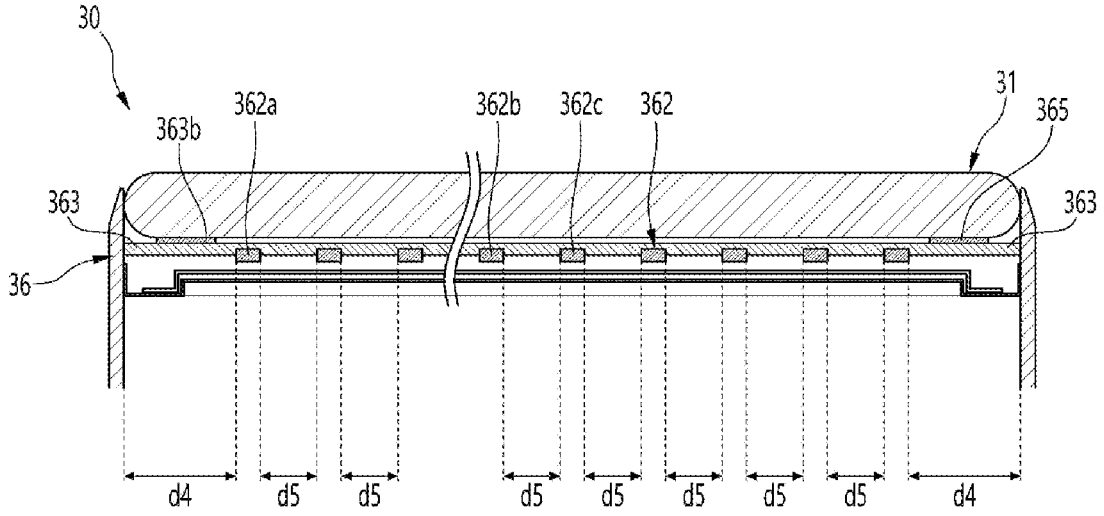

FIG. 15 is a cross-sectional view illustrating a lighting device according to a second embodiment.

Meanwhile, the lighting device 36 according to the second embodiment of the present disclosure is characterized in that the light sources 364 are arranged in a set shape.

For example, the lighting device 36 may include a base 363 formed of a film or a flexible material, and a light source 364 mounted on the base 363.

The base 363 may correspond to the front surface of the door 20 or may be formed in a smaller size. For example, the base 363 may be formed in a rectangular plate shape. In addition, the light source 364 may be arranged spaced apart from the base 363 at set intervals.

At this time, in the lighting device 36 according to the first embodiment, the light sources 364 may be regularly arranged in a matrix shape on the base 363.

Meanwhile, the lighting device 36 according to the second embodiment may be arranged by varying the distance between the side end portion of the base 363 and the first light source 364 arranged closest to the end portion, and the distance between the second light source 364 and the third light source 364 arranged adjacent to each other in the center portion of the base 363.

For example, as illustrated in FIG. 15 (*a*), the distance d2 between the end portion of the base 363 and the first light source 364 may be shorter than the distance d3 between the second light source 364 and the third light source 364 arranged adjacent to each other at the center portion of the base 363. In other words, the distance d2 between the end portion of the base 363 and the first light source 364 may be shorter than the pitch of the light sources 364 arranged at the center portion of the base 363.

Alternatively, the distance between the adjacent light sources 364 may be gradually narrowed from the center portion of the base 363 toward the end portion of the base 363. In other words, the pitch of the light sources 364 may be arranged to become smaller toward the end portion of the base 363.

In this case, the luminance of the light on the side of the lighting device 36 can be different from that of the center portion. Accordingly, the front surface of the door 20 can uniformly and brightly shine as a whole.

As another example, as illustrated in FIG. 15(*b*), the distance d4 between the end portion of the base 363 and the first light source 364 may be longer than the distance d5 between second light source 364 and the third light source 364 arranged adjacent to each other at the center portion of the base 363. In other words, the distance d3 between the end portion of the base 363 and the first light source 364 may be longer than the pitch of the light sources 364 arranged at the center portion of the base 363.

Alternatively, the interval between the adjacent light sources 364 may gradually widen from the center portion of the base 363 toward the end portion of the base 363. In other words, the pitch of the light sources 364 may be arranged to increase toward the end portion of the base 363.

In this case, the luminance of the light on the side of the lighting device 36 can be different from that of the center portion thereof. Accordingly, the front surface of the door 20 can be uniformly and brightly illuminated as a whole.

Figure 16:
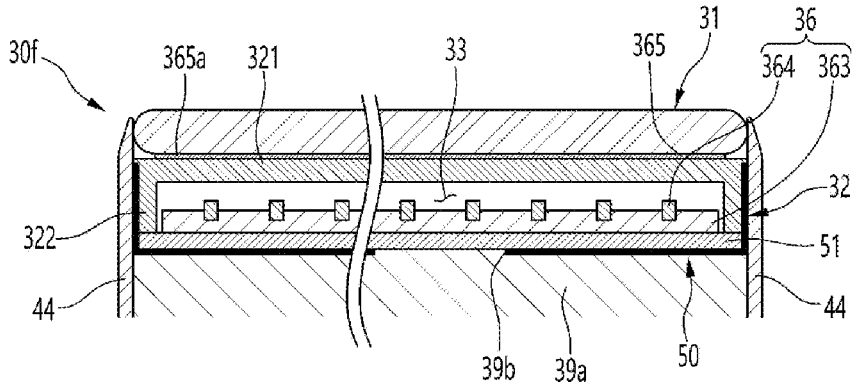
FIG. 16 is a cross-sectional view illustrating a panel assembly according to a seventh embodiment.

FIG. 16 is a cross-sectional view illustrating a panel assembly according to a seventh embodiment.

The panel assembly 30*g* according to the seventh embodiment of the present disclosure includes the panel 31, the lighting device 36, and a separation portion 32 forming an air gap 33 between the lighting device 36 and the panel 31.

A support member 51 is included behind the lighting device 36. The support member 51 may be provided in contact with the rear surface of the lighting device 36 and the rear surface of the separation portion 32.

The panel assembly 30*g* includes a separation portion 32 and a fixing member 50 in contact with at least a portion of the support member 51. The fixing member 50 is made of a metal material, and is formed to contact one side of the separation portion 32 and a portion of the rear surface of the support member 51 to prevent the lighting device 36 from moving.

Meanwhile, in the panel assembly 30*g* according to the seventh embodiment, the panel 31 and the separation portion 32 may be coupled to each other by an adhesive member 365*a*. The adhesive member 365*a* is made of a material capable of transmitting light, so that interference of light emitted from the lighting device 36 can be minimized.

In addition, the panel assembly 30*g* according to the seventh embodiment includes the support member 51 and the back cover 39*a* in contact with at least a portion of the fixing member 50. The back cover 39*a* has an insertion groove 39*b* into which the fixing member 50 is inserted. In a state where the fixing member 50 is inserted into the insertion groove 39*b*, the back cover 39*a* may form a flat surface.

Figure 17:
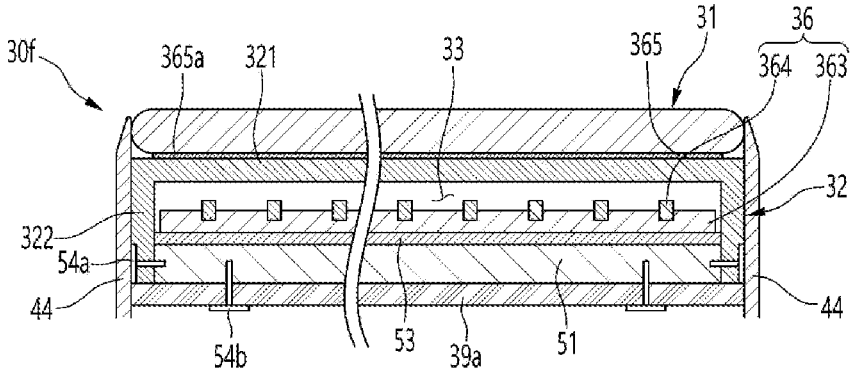
FIG. 17 is a first cross-sectional view illustrating a panel assembly according to an eighth embodiment.
Figure 18:
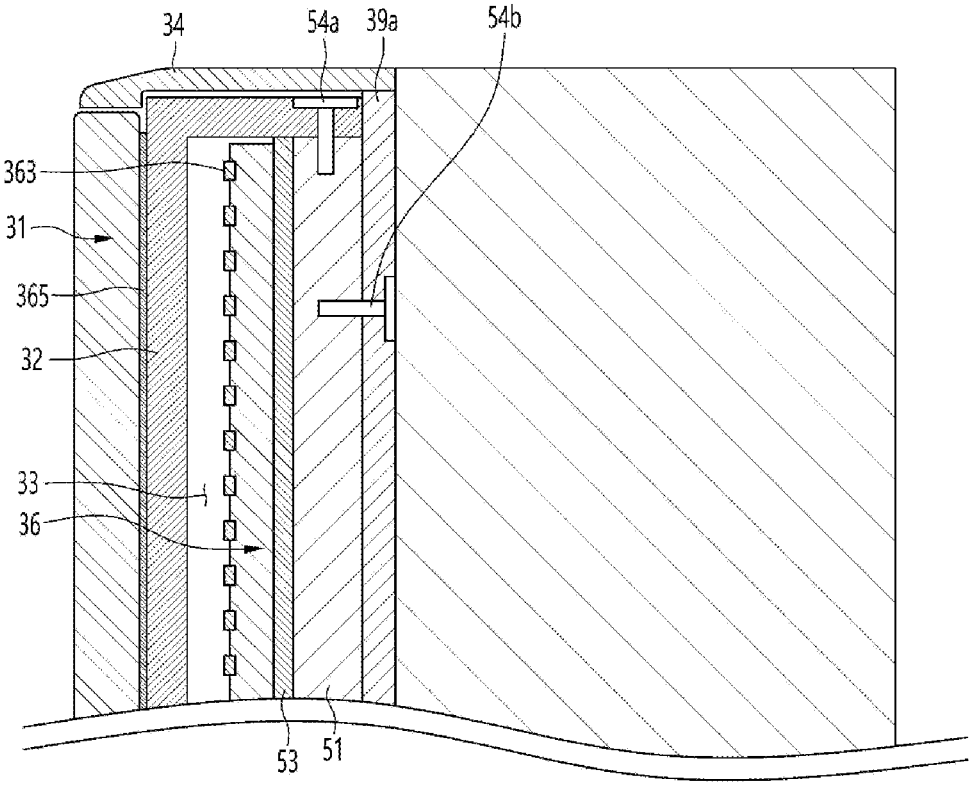
FIG. 18 is a second cross-sectional view illustrating a panel assembly according to an eighth embodiment.

FIG. 17 is a first cross-sectional view illustrating a panel assembly according to an eighth embodiment, and FIG. 18 is a second cross-sectional view illustrating a panel assembly according to an eighth embodiment.

The panel assembly 30*h* according to the eighth embodiment further includes a separation adjusting portion 53 between the lighting device 36 and the support member 51. The separation adjusting portion 53 may adjust the height of the air gap between the lighting device 36 and the panel 31.

The separation portion 32 may be formed so that the rear surface and the front surface of the panel 31 come into contact with each other and extend rearward to contact the back cover 39*a*. In this case, the separation portion 32 is formed to correspond to the length of the panel 31 and the back cover 39*a* in the front and rear direction, so the distance of the air gap may be determined according to the length of the separation portion.

At this time, as the distance of the air gap increases, the light emitted from each light source is diffused so that a natural color can be expressed on the entire surface of the panel, while it may appear blurry. As the distance of the air gap is closer, the light emitted from the light source may appear prominent in a dot shape.

The separation adjusting portion 53 is detachably provided at the rear of the lighting device to enable adjustment of the distance between the lighting device 36 and the separation portion 32. The separation adjusting portion 53 may be formed of a plastic injection molding material or a metal material such as aluminum. For example, when formed of a metal material, there is an advantage in that a heat dissipation effect can be obtained by conducting heat generated from the lighting device 36.

In addition, the panel assembly 30*h* according to the eighth embodiment includes a coupling structure by fastening members 54*a* and 54*b* to more firmly fix the separation portion 32.

The fastening member 54*a* passes through both side surfaces of the separation portion 32 and is inserted into the support member 51 to couple the separation portion 32 and the support member 51 together.

In addition, the support member 51 may be coupled to each other by the back cover 39*a* and the fastening member 54*b*. In this case, the fixing member can be omitted.

Figure 19:
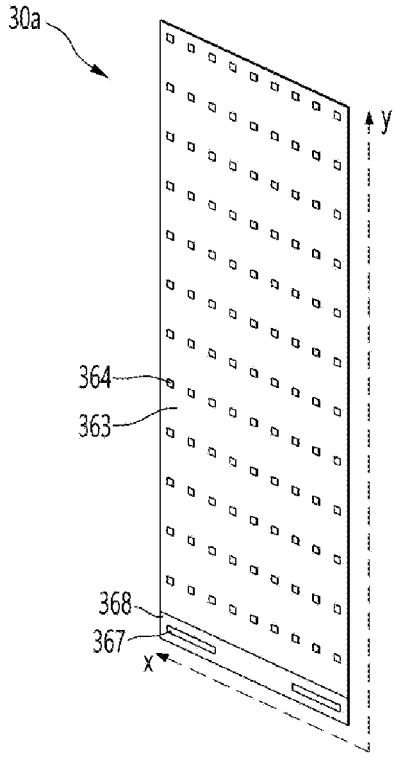
FIG. 19 is a perspective view illustrating the lighting device viewed from the rear.
Figure 20:
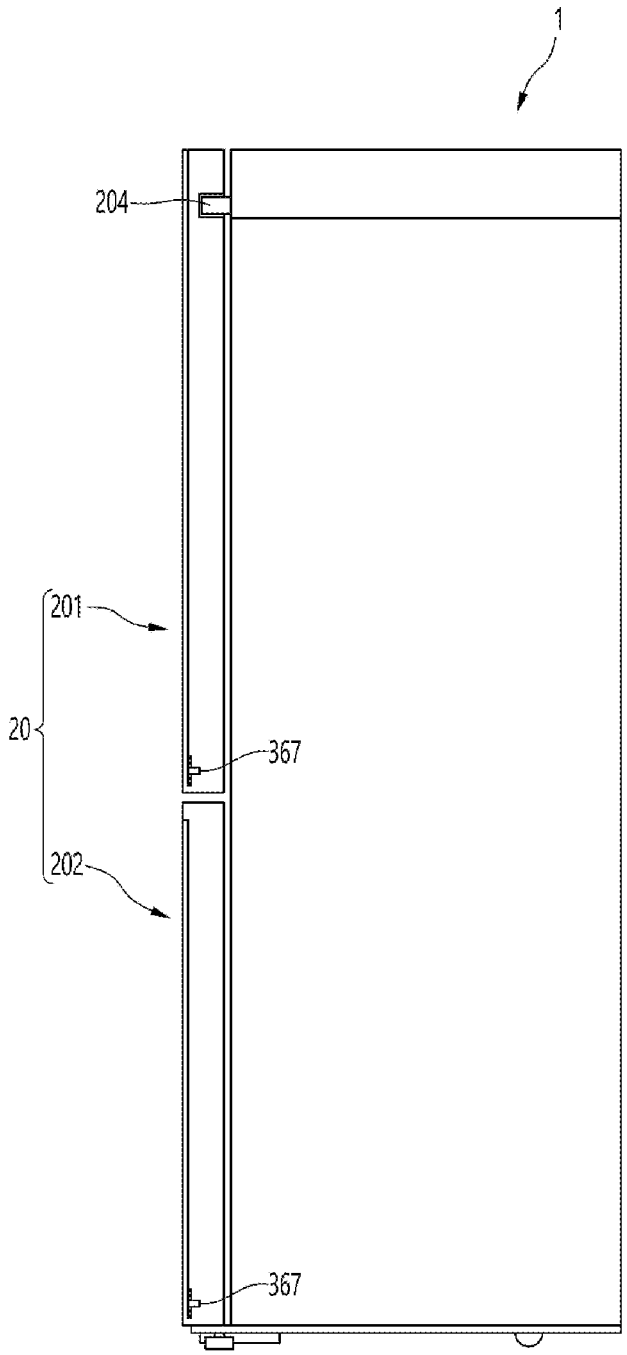
FIG. 20 is a side view illustrating a refrigerator for explaining a position where a PCB connector for controlling the lighting device is provided.

FIG. 19 is a perspective view illustrating the lighting device viewed from the rear, and FIG. 20 is a side view illustrating a refrigerator for explaining a position where a PCB connector for controlling the lighting device is provided.

The panel assembly 30 according to an embodiment of the present disclosure may include a lighting PCB 368 that controls the operation of the light source 364 of the lighting device 36. The lighting PCB 368 may be provided independently on each door 20 in which the lighting device 36 is installed. The lighting device 36 may shine with a set color or image by controlling the operation of the light source 364 by the lighting PCB 368.

The lighting PCB 368 may be provided at a lower end of the lighting device 36. The lighting PCB 368 may be provided at the bottom of the rear surface of the lighting device 36.

For example, in the lighting device 36, in a state where a plurality of light sources 364 are arranged in a row on the base 363, the lighting PCB 368 may be spaced downward at set intervals from a light source 364 disposed at the bottom of the base 363.

Meanwhile, the lighting device 36 may be formed in a size corresponding to that of the door 20. For example, the lighting device 36 may be mounted on the panel assembly 30 by cutting an upper end portion of the lighting device 36 corresponding to the vertical length of the door 20.

At this time, it is preferable that the lighting PCB 368 is provided at the lower end portion of the panel assembly 30. By arranging the lighting PCB at the lower end and cutting the lower end portion of the lighting device 36, the lighting PCB can be easily provided in a size corresponding to that of the panel assembly 30.

In addition, a PCB connector 367 electrically connecting the lighting PCB 368 and the controller 38 may be provided in the door 20.

The PCB connector 367 is configured to connect a wire connected to the lighting PCB 368 and a wire connected to the controller 38 to each other.

The PCB connector 367 may be provided at the lower end portion of the door 20. In detail, the PCB connector 367 may be provided independently on each door equipped with the lighting device 36.

The PCB connector 367 may be provided on a rear surface of the lighting PCB 368. In other words, the PCB connector 367 may be provided at the lower end portion of the door 20. The lighting PCB 368 is provided at the lower end portion of the panel assembly 30, and a PCB connector 367 connected to the lighting PCB 368 is provided on the rear surface of the lighting PCB 368 and thus can be connected with wires connected to the controller 38.

With this structure, the lighting device 36 is easily provided in a size corresponding to that of the panel assembly 30, so assembly and operation are easy.

Figure 21:
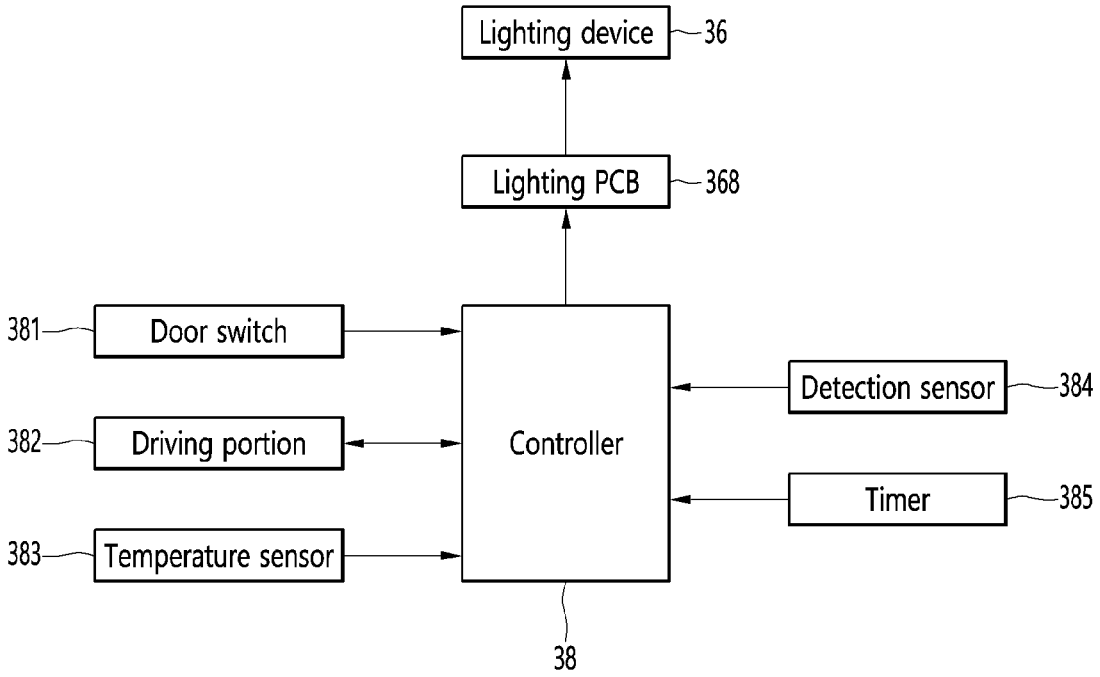
FIG. 21 is a block diagram illustrating the flow of a control signal of a refrigerator according to an embodiment of the present disclosure.
Figure 22:
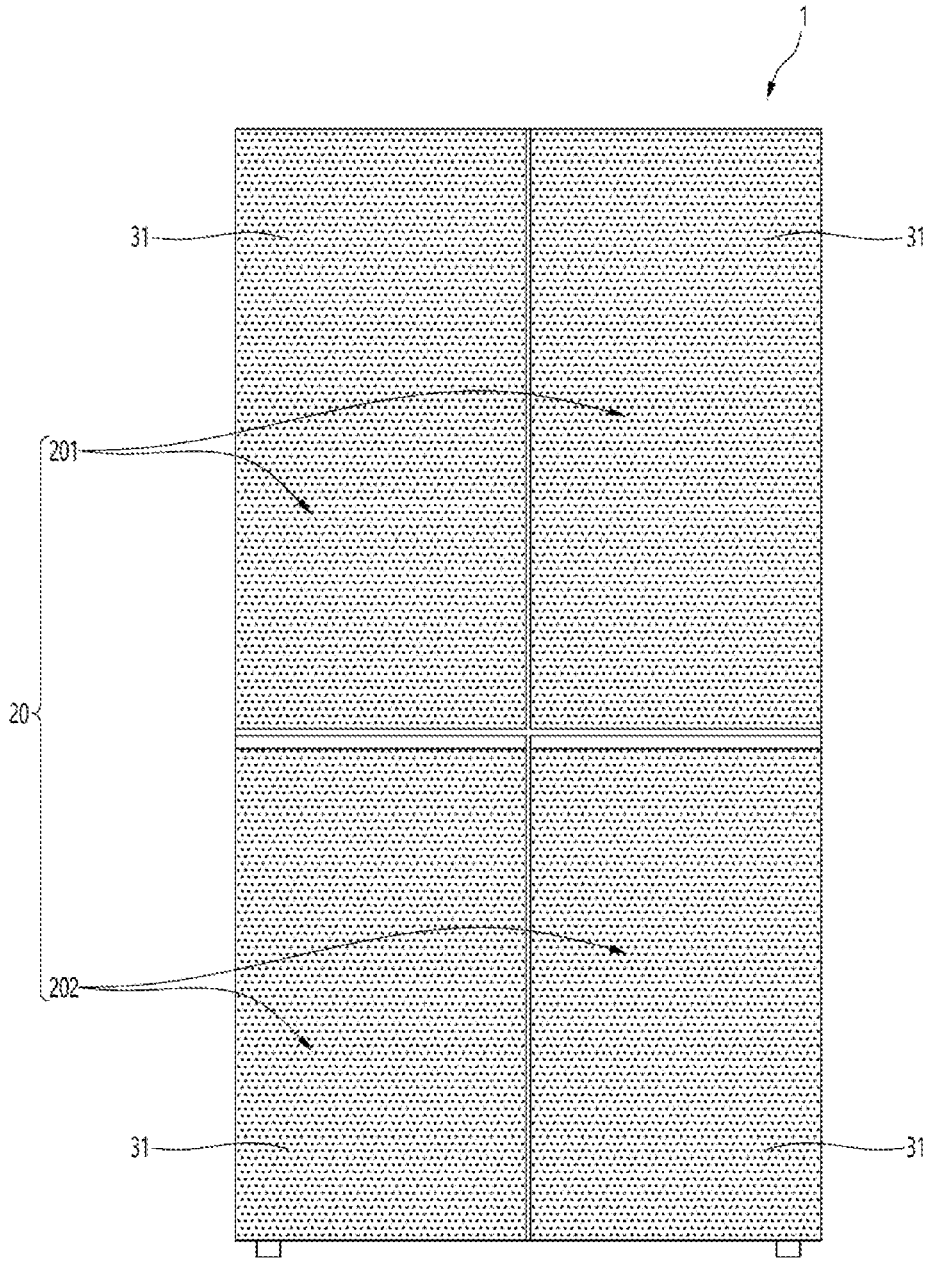
FIG. 22 is a front view illustrating a state where the color of the front surface of the door is changed by driving the lighting device of the door according to the first embodiment.

FIG. 21 is a block diagram illustrating the flow of a control signal of a refrigerator according to an embodiment of the present disclosure, and FIG. 22 is a front view illustrating a state where the color of the front surface of the door is changed by driving the lighting device of the door according to the first embodiment.

In a state where the lighting device 36 is turned off, the outer appearance color of the front surface can be expressed by the color of the panel 31. A color displayed on the panel 31 when the lighting device 36 is turned off may be referred to as a first color.

When the lighting device 36 is operated, the color of the panel 31 is changed according to the color of the light emitted from the lighting device 36, and the color of the front outer appearance surface of the door 20 can be expressed as the selected color. At this time, the color displayed through the panel by the light emitted from the lighting device 36 may be referred to as a second color.

At this time, the color of the light itself emitted from the LED 364 and the color displayed on the panel 31 may be different from each other. In other words, in a state where the lighting device 36 is turned off, the color of the panel 31 itself may be referred to as a first color.

In addition, the color of the light emitted from the LED 364 may be referred to as a third color. Light emitted from the LED 364 may be mixed with the first color while passing through the panel 31. In addition, in a state where the lighting device 36 is turned on, the second color may be displayed through the panel 31.

In other words, the first color of the panel 31 itself and the second color emitted by the LED 364 may be different from each other. In addition, in order to make the panel 31 shine with the second color set by the user from the light emitted with the third color, color correction may be performed by the remote device or the refrigeration processor of the refrigerator itself. In other words, in a state where the lighting device 36 is turned on, in order to display the panel 31 in the second color set by the user, considering the first color unique to the panel 31 itself, the lighting device (36) may emit the panel 31 with the corrected light of the third color so that the panel 31 is displayed in the second color. In addition, the third color may be mixed with the first color so that the panel 31 is displayed in the second color set by the user.

The color of the panel 31 may be determined by the operation of the lighting device 36. For example, the lighting device 36 may be operated and set through a remote device (2 in FIG. 16) spaced apart from the refrigerator 1. For example, the remote device 2 may be various devices capable of communication, such as a dedicated terminal, a mobile phone, a tablet, a portable PC, a desktop PC, a remote controller, and a Bluetooth speaker.

The user can generally manipulate and set the operating state of the lighting device 36, such as the operating time, operating conditions, and light emission color of the light source of the lighting device 36, through manipulation of the remote device 2. For example, simple manipulation and setting of the lighting device 36 may be possible through an application installed in a user's mobile phone or a dedicated program. In other words, the user can select a desired color of the panel 31 through the screen of the remote device 2 such as a mobile phone or a terminal.

In addition, the user may input a color through a manipulation portion provided in the refrigerator 1 without using the remote device 2.

In addition, the refrigerator 1 and the remote device 2 may be connected to the server through a network, and thus, the color of the panel 31 of the refrigerator 1 may be input through the server.

Meanwhile, regarding the operating state of the lighting device 36, when the lighting device 36 is turned on, the light emitted from the LED 364 may be emitted toward the rear surface of the panel 31.

In other words, the light emitted from the LED 364 shines the panel 31, and the front surface of the door 20 may shine with a set brightness or color.

In a state where the lighting device 36 is turned off, as illustrated in FIG. 1, the front surface of the door 20 does not shine, and the original color, that is, the first color of the panel assembly 30 is displayed. In this state, the lighting device 36 can be turned on, and when the lighting device 36 is turned on, the front surface of the door 20 shines in a second color selected by the user.

For example, the controller may control the front surface of the door 20 to shine in a second color different from the first color, and, in the lighting device 36, the LED 364 can shine with the set color according to the control of the controller. At this time, the color of the panel 31 can be selected by the user and can be selected by manipulating the remote device 2.

Meanwhile, when the controller instructs to change the color of the light emitted from the lighting device 36 in a state where the front outer appearance of the refrigerator 1 shines in a set color, the panel 31 shines in a different color reset by the controller.

In addition, the panel 31 constituting some of the plurality of doors 20 forming the front outer appearance of the refrigerator 1 emits light or the panel 31 constituting the plurality of doors 20 may independently emit light in different colors to form the front outer appearance of the refrigerator 1.

Meanwhile, the lighting device 36 may have various operation types according to user settings, and the operation of the lighting device 36 may be controlled by the controller 38.

For example, the lighting device 36 may continuously maintain an on/off state according to a user's on/off manipulation. In addition, it is turned on at a designated time input from the timer 385 or at a set time interval to change the color of the front surface of the door 20.

In addition, the lighting device 36 may be operated according to the operating state of the refrigerator 1. For example, the lighting device 36 may be operated according to the operation mode or state of the refrigerator 1 to change the color of the front surface of the door 20. Therefore, the user can intuitively know the operating state or mode of the refrigerator 1 through the color of the door 20.

In addition, the lighting device 36 may be operated according to the door switch 381. In detail, when the door 20 is open fora long time and no signal is input from the door switch 381 for a set time or more, the lighting device 36 is operated to notify the opening of the door 20 so that the front surface of the door 20 can be made to shine in a different color. In addition, the lighting device 36 may notify the user of the opening of the door 20 more effectively by repeatedly turning on and off. Therefore, even if the door 20 is not completely closed due to a users mistake, it can be effectively notified through the color or color change of the front surface of the door 20.

In addition, the lighting device 36 may be operated according to the operation of the driving portion 382 for the operation of the refrigerator 1. For example, the driving portion 382 may be a compressor. In detail, if the controller 38 determines an abnormal operation or failure of the compressor, the lighting device 36 can be operated correspondingly. In other words, when it is determined that the compressor has an abnormality, the lighting device 36 can make the front surface of the door 20 shine in a set color or repeatedly turn on and off to inform the user of the abnormality.

In addition, the driving portion 382 may be configured in various ways such as a defrost heater, a deodorization device, an ice maker, a water purifier, and the like, and the lighting device 36 may be operated in connection with the operation of these driving portions 382. As another example, the lighting device 36 may be operated according to the amount of ice made in the ice maker, and the state of the ice maker or the amount of ice made may be displayed through the color of the door 20.

In addition, the lighting device 36 may be operated according to the internal temperature detected by the temperature sensor 383. For example, the lighting device 36 makes the front surface of the door 20 shine in a set color according to a set temperature range so that the temperature state can be intuitively recognized. In addition, the lighting device 36 may shine the front surface of the door 20 in a different color when the temperature detected by the temperature sensor 383 is out of a set range.

In addition, the lighting device 36 may be operated according to the detection sensor 384. For example, the detection sensor 384 may be a proximity sensor. In detail, when the proximity sensor detects the user's proximity, the brightness of the door 20 can be made darker by lowering the output of the lighting device 36 to prevent the user's glare.

In addition, the lighting device 36 may shorten a color change cycle by the lighting device 36 or cause the change to start when a user's proximity is detected by a detection sensor, and as the LEDs 364 of the lighting device 36 are sequentially operated, a set operation may be performed when the user approaches, such as continuously changing colors.

As another example, the detection sensor 384 may be an illuminance sensor. According to the illuminance detected by the illuminance sensor, the brightness of the door 20 may be adjusted by controlling the operation of the lighting device 36.

In addition, the lighting device 36 may be operated according to the state of not only the refrigerator but also other devices that are networked or communicable with the refrigerator 1. For example, when washing of the washing machine or dryer is completed, the door shines in a set color by the operation of the lighting device 36 to inform the user of the state of the washing machine or dryer.

In addition, it may be possible to output a screen through the panel 31 by operating the lighting device 36.

In detail, through the on-off of the plurality of LEDs 364 and/or the color of the LEDs 364 that are turned on constituting the lighting device 36, texts, pictures, figures, images, and videos may be output on the panel 31. In other words, the panel assembly may function like an output device displaying a kind of screen that can be expressed by the lighting device, and thus the panel 31 may be referred to as a screen or a display.

For example, when a user selects texts, pictures, images, or the like to be output to the door 20 from the remote device 2 or input portion, the controller 38 may receive the user-selected information. In addition, the controller 38 may transmit the received information to the lighting PCB 368. The lighting PCB 368 may control the lighting device 36 to output texts, pictures, or the like selected by the user.

In addition, the operation of the lighting device 36 that outputs the screen can be set by the user through a program or application built in the remote device 2. Therefore, the user can freely output desired videos, images, texts, or the like to the panel 31 through the user's manipulation of the remote device 2 rather than direct manipulation of the refrigerator 1, and through this, there is an advantage in that information can be delivered to the user.

In addition, the refrigerator 1 is connected to the user's remote device 2 and the server through a network to communicate necessary information, and based on the information obtained through communication, the information can be displayed on the panel 31.

Figure 23:
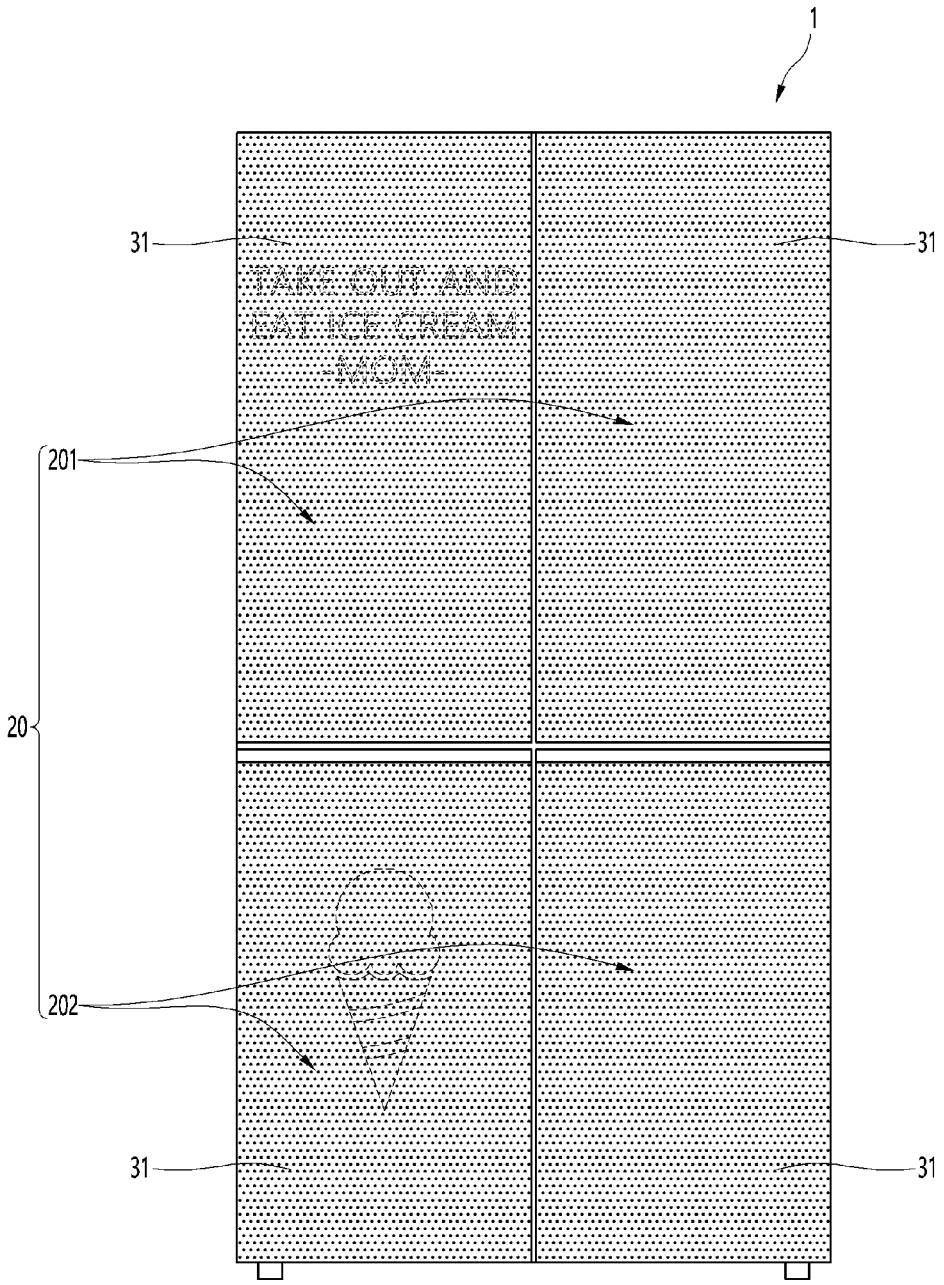
FIG. 23 is a front view illustrating a state where a door lighting device is driven and output is made to the front surface of the door according to the second embodiment.
Figure 24:
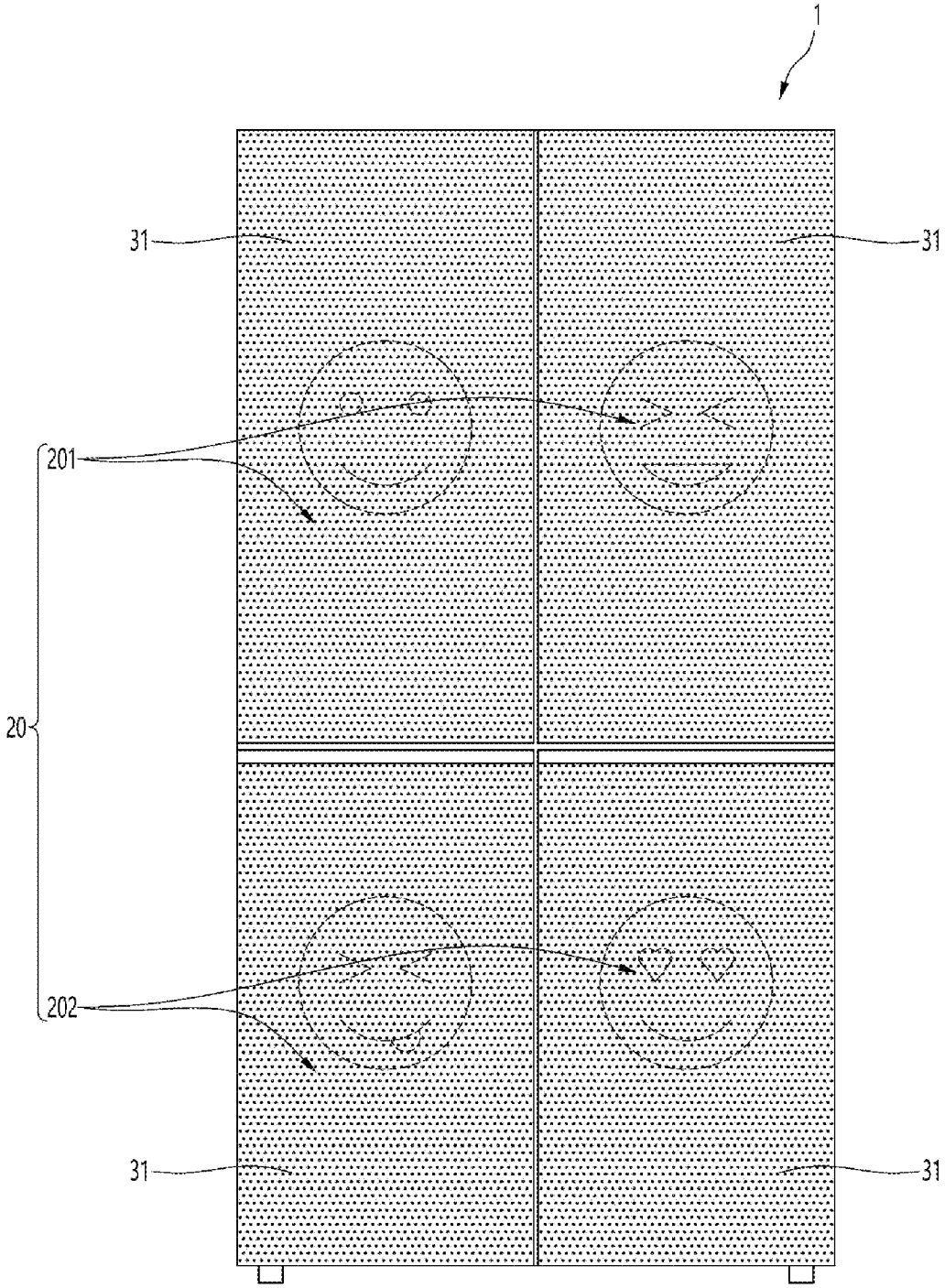
FIG. 24 is a front view illustrating a state where a door lighting device is driven and output is made to the front surface of the door according to the third embodiment.

FIG. 23 is a front view illustrating a state where a door lighting device is driven and output is made to the front surface of the door according to the second embodiment, and FIG. 24 is a front view illustrating a state where a door lighting device is driven and output is made to the front surface of the door according to the third embodiment.

For example, as illustrated in FIG. 23, the controller 38 controls the matrix LED of the lighting device 36 to express a GUI such as texts, pictures, or figure images on the front surface of the door 20 of the refrigerator 1.

Among the plurality of doors, the first door 201*a* may output texts input by the user through a remote device or an input portion. For example, a user may select a door to be output through a remote device while out of the house, and input a message to be output to the selected door.

The controller may receive the door and message information selected by the user, and output a message of "Take out and eat ice cream" to the first door 201*a* through the lighting device 36. The message may be implemented by the lighting device 36.

In addition, among the plurality of doors, the third door 202*a* can output a GUI such as a figure image set by the user through a remote device or an input portion through the lighting device 36. For example, the user may select a door desired to be output through a remote device and select an emoticon to be output on the selected door.

The controller may receive information about the door and the emoticon selected by the user and output an emoticon related to ice cream to the third door 202*a* through the lighting device 36.

At this time, the controller 38 may include LED coordinate value (X, Y) information for outputting the received message or emoticon. The LED coordinate value information may include positions of light sources which are turned on and color information which is output from the light sources to output the message or emoticon.

In other words, the controller 38 may independently control each light source by utilizing position information of each of the light sources arranged in a matrix form of the lighting device.

Each of the matrix LEDs has information on coordinate values (X, Y) where light sources are disposed and can output texts or images according to each scenario based on input time, sequential information, or time.

Accordingly, it is also possible to express a fixed image or an image that moves according to time and can be controlled to enable natural and diverse color expression.

For example, as illustrated in FIG. 24, different GUIs may be output to each of a plurality of doors. In addition, one CUI integrated with a plurality of doors may be output.

Figure 25:
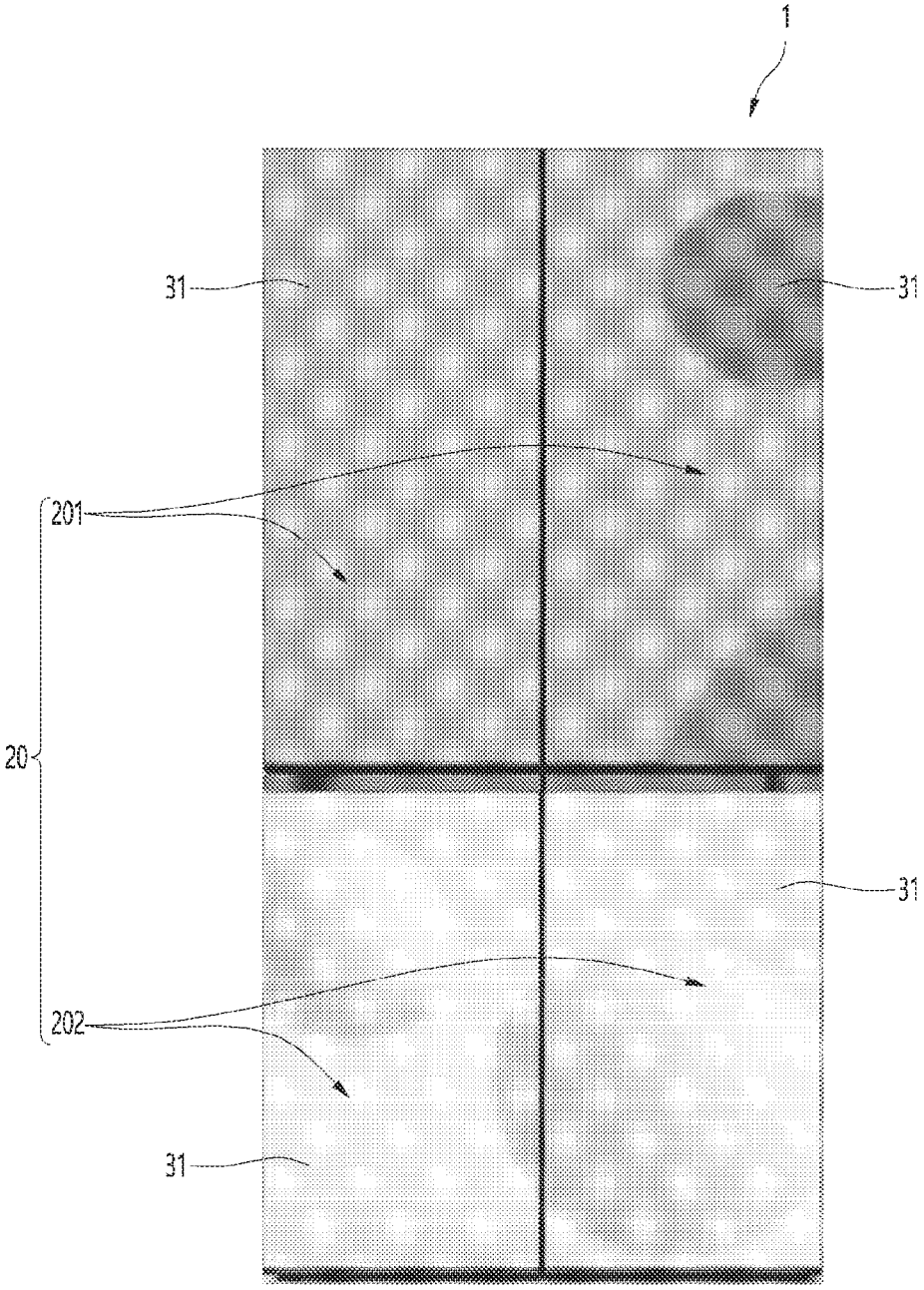
FIG. 25 is a front view illustrating a state where a door lighting device is driven and output is made to the front surface of the door according to the fourth embodiment.
Figure 26:
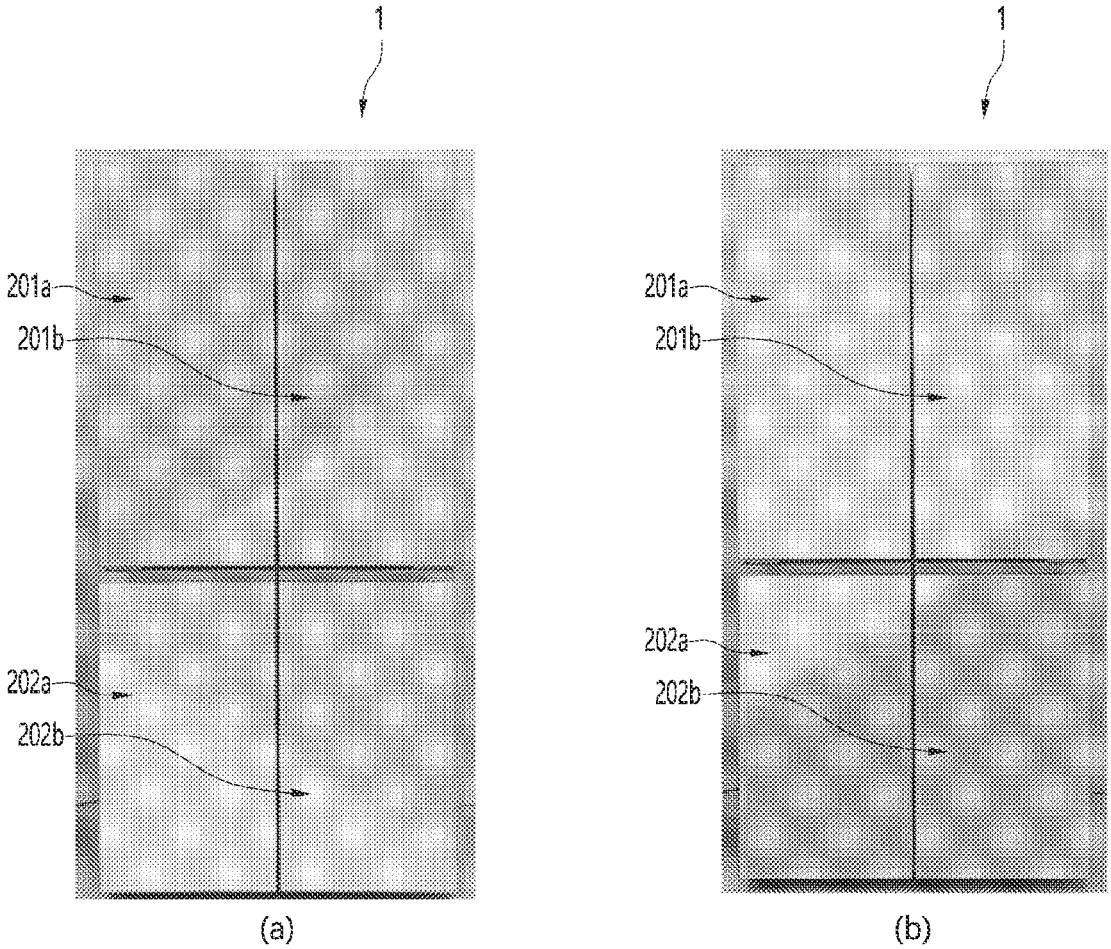
FIG. 26 is a front view illustrating a state where a door lighting device is driven and output is made to the front surface of the door according to the fifth embodiment.
Figure 27:
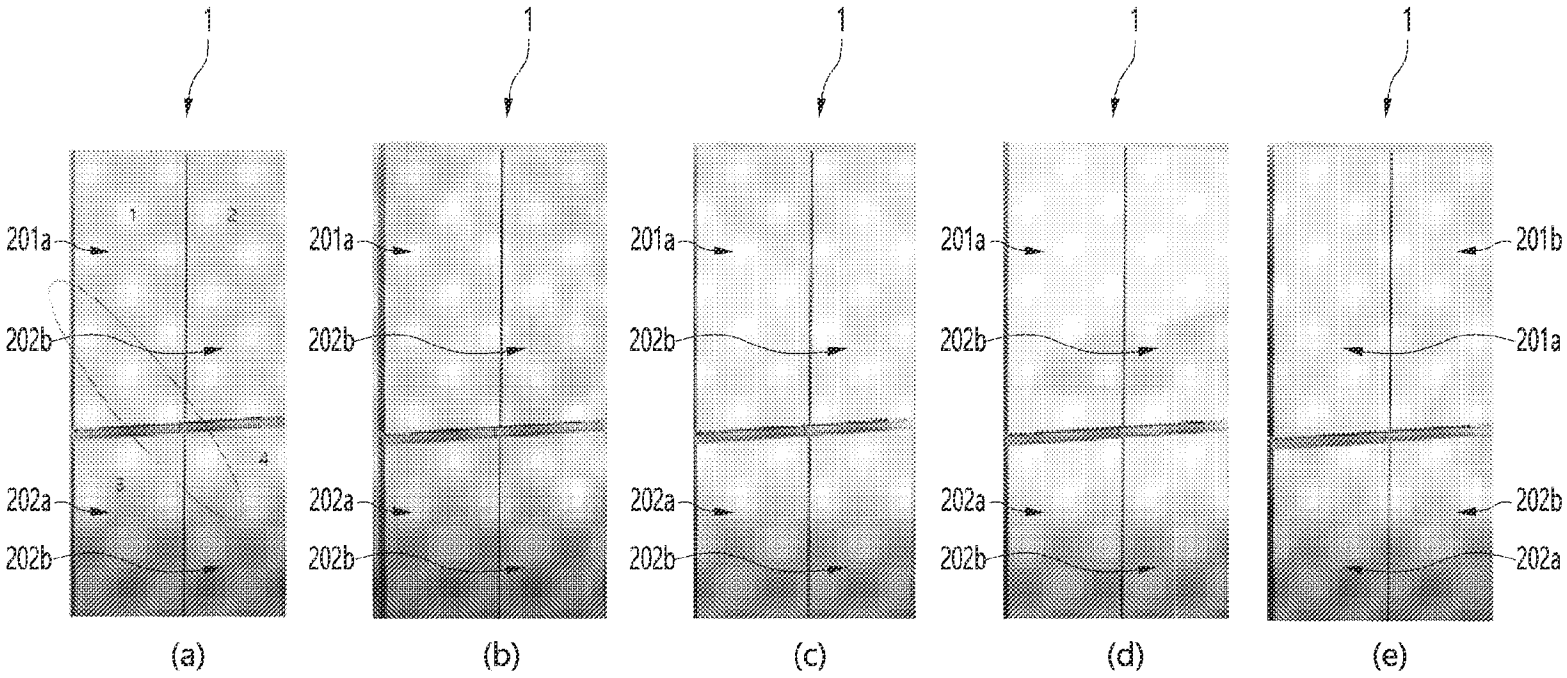
FIG. 27 is a front view illustrating a state where a door lighting device is driven and output is made to the front surface of the door according to the sixth embodiment.

FIG. 25 is a front view illustrating a state where a door lighting device is driven and output is made to the front surface of the door according to the fourth embodiment, FIG. 26 is a front view illustrating a state where a door lighting device is driven and output is made to the front surface of the door according to the fifth embodiment, and FIG. 27 is a front view illustrating a state where a door lighting device is driven and output is made to the front surface of the door according to the sixth embodiment.

According to one embodiment of the present disclosure, as illustrated in FIG. 25, a pair of upper doors 201 can implement images or videos with a sense of unity. In addition, the lower door 202 can implement an image or video with a sense of unity independently of the upper door 201.

For example, an image or video in which the boundary surfaces of the lower left door and the lower right door are connected to each other may be output on the lower door 202.

According to one embodiment of the present disclosure, as illustrated in FIG. 25, a pair of upper doors 201 and a pair of lower doors 202 may integrally implement one image or video.

In detail, when the image output starts, each door may brightly shine different colors in a plurality of areas, as illustrated in FIG. 25 (*a*). In addition, as the video output is reproduced, a plurality of regions partitioned in different colors may move in different positions. At this time, the left and right upper doors 201*a* and 201*b* and the left and right lower doors 202*a* and 202*b* are connected to each other to output an image with a sense of unity.

For example, the image or video information received by the controller 38 and selected by the user may include coordinate values (X, Y) and color information at which the LED corresponding to the time T+1, T+2, T+3, . . . at which the output was progressed from the time T at which the video output started is turned on.

For example, a coordinate value at which the LED is turned on may be set a line extending in a horizontal direction of the lighting device as an X-axis direction and a line extending in a vertical direction of the lighting device as a Y-axis direction. In addition, the position of each LED arranged in a matrix form may be set as coordinate values (X, Y).

The controller 38 may transmit the received image or video information to the lighting PCB 368. Upon receiving the image or video information, the lighting PCB 368 may control the lighting device 36 to turn on the light source of the lighting device in time order, so that the received image or video can be controlled to be output to the panel 31.

In addition, according to an embodiment of the present disclosure, as illustrated in FIG. 27 (*a*) and FIG. 27(*b*), a plurality of doors may output one screen. Alternatively, as illustrated in FIG. 27(*c*), a shape in which clouds move naturally from left to right may be output. Alternatively, as illustrated in FIG. 27(*d*), a shape in which flows or waves roll in an up and down direction may be output. Alternatively, as illustrated in FIG. 27(*d*), a snow falling shape may be output.

In this way, each of a plurality of doors can be output as an independent screen or a single screen in which a plurality of doors are integrated can be output.

For example, the image or video information may include coordinate values (X, Y) and color information at which independent LED of each of a plurality of doors is turned on. Specifically, the image or video information may include a first LED coordinate value based on the matrix LED of the first door 201*a*, a second LED coordinate value based on the matrix LED of the second door 201*b*, a third LED coordinate value based on the matrix LED of the third door 202*a*, and a fourth LED coordinate value information based on the matrix LED of the fourth door 202*b*.

As another example, the image or video information may include a single LED coordinate value based on the entire front surface formed of a plurality of doors.

For example, all of the first door 201*a*, the second door 201*b*, the third door 202*a*, and the fourth door 202*b* may include LED coordinate values based on one X axis and one Y axis.

As such, according to an embodiment of the present disclosure, a plurality of doors may be controlled with independent LED coordinate values, or the entire plurality of doors may be controlled with a single LED coordinate value.

Meanwhile, panel assemblies according to embodiments of the present disclosure may be applied not only to refrigerators but also to various other home appliances.

Figure 28:
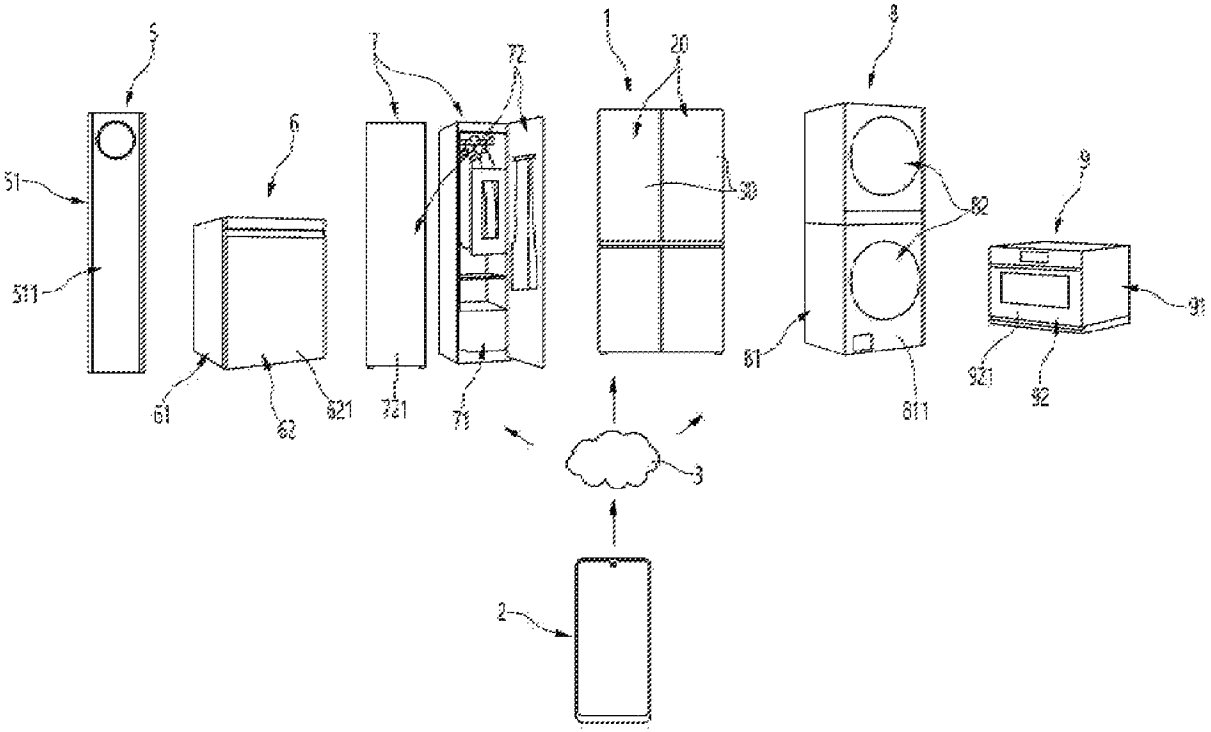
FIG. 28 is a view illustrating an example of adjusting the color of home appliances to which the panel assembly is applied using a remote device.

FIG. 28 is a view illustrating an example of adjusting the color of home appliances to which the panel assembly is applied using a remote device.

As illustrated in the drawing, the outer appearance of the home appliance according to the embodiment of the present disclosure may be formed by the panel assembly 30, and the outer appearance thereof may be changed in a color set by the user according to the operation of the lighting device 36. The outer appearance of the panel assembly 30 can be expressed in various colors by the light of the lighting device 36 emitted from the rear of the panel 31, and pictures, texts, images, and video can be output on the screen.

The home appliance may be any one of a refrigerator 1, an air conditioner 5, a dishwasher 6, a clothes care machine 7, a washing machine 8, or a cooking appliance 9, and the same structure as the panel assemblies 30, 30*a*, 30*b*, and 30*c* of the embodiments of the present disclosure is applied to each of them so that the color of the front outer appearance can be freely changed.

For example, as in the above-described embodiments, in the refrigerator 1, the panel assembly 30 may be provided on a front surface of the door 20 that opens and closes the cabinet 10. In addition, the panel assembly 30 shines in a set color according to a user setting, and the color of the front outer appearance of the refrigerator 1 can be changed.

As another example, a space provided with a heat exchanging device and a fan may be formed inside the case 51 (or cabinet) forming the outer appearance of the indoor device of the air conditioner 5. In addition, the front surface of the case 51 may be formed by the panel assembly 511.

The panel assembly 511 may have the same structure as the panel assembly 30 of the refrigerator 1 described above and emit light.

Accordingly, the panel assembly 511 can shine in a set color according to a user setting, and the color of the front outer appearance of the indoor device of the air conditioner 5 can be changed to the set color.

As another example, in the dishwasher 6, a space for washing dishes may be formed inside the case 61 (or cabinet) forming the outer appearance. In addition, the front surface of the case 61 may be opened and closed by the door 62, and the front surface of the door 62 may be formed by the panel assembly 621. The panel assembly 621 has the same structure as the panel assembly 30 of the refrigerator 1 described above and can emit light.

Accordingly, the panel assembly 621 can shine in a set color by a user setting, and the color of the front outer appearance of the dishwasher 6 can be changed to the set color.

As another example, a space in which clothes are stored may be formed inside a case 71 (or cabinet) forming an outer appearance of the clothes care machine 7. In addition, the front surface of the case 71 may be opened and closed by a door 72, and the front surface of the door 72 may be formed by a panel assembly 721. The panel assembly 721 has the same structure as the panel assembly 30 of the refrigerator 1 described above and can emit light.

Accordingly, the panel assembly 721 can shine in a set color according to a user setting, and the color of the front outer appearance of the clothes care machine 7 can be changed to the set color.

As another example, in the washing machine 8 or dryer, a space for washing or drying may be formed inside the case 81 (or cabinet) forming the outer appearance. In addition, the front surface of the case 81 may be opened and closed by a door 82. Meanwhile, the front surface of the case 81 may be formed by the panel assembly 811. The panel assembly 811 has the same structure as the panel assembly 30 of the refrigerator 1 described above and can emit light.

Accordingly, the panel assembly 30 may shine in a set color by a user setting, and the color of the front outer appearance of the washing machine 8 or dryer may be changed to the set color.

As another example, a space for cooking food may be formed inside the case 91 (or cabinet) forming the outer appearance of the cooking appliance 9. In addition, the front surface of the case 91 may be opened and closed by a door 92, and the front surface of the door 92 may be formed by a panel assembly 921. The panel assembly 921 has the same structure as the panel assembly 30 of the refrigerator 1 described above and can emit light.

Accordingly, the panel assembly 921 can shine in a set color by a user setting, and the color of the front outer appearance of the cooking appliance 9 can be changed to the set color.

What is claimed is:

1. A home appliance comprising:

a cabinet defining a storage space; and a door configured to open and close the storage space, wherein the door includes:

a door body, and a panel assembly disposed at the door body and defining a front surface of the door, wherein the panel assembly includes:

a panel defining the front surface of the door, a lighting device having a size corresponding to a size of the panel and comprising a plurality of light sources configured to emit light toward the panel, and a separation portion provided between the panel and the lighting device, and wherein the separation portion is configured to, based on being contacted with a rear surface of the panel, be spaced apart from the light source, and wherein the separation portion includes:

a front portion contacting the rear surface of the panel, overlapping the light source, and configured to diffuse light emitted from the light source, and a side portion extending from the front portion toward the lighting device.

2. The home appliance of claim 1, wherein the panel assembly defines an air gap through which air flows between the front portion of the separation portion and the lighting device.

3. The home appliance of claim 1, wherein the lighting device includes:

a base including at least one film layer, and wherein the plurality of light sources is disposed on the base.

4. The home appliance of claim 3, wherein an interval between neighboring light sources of the plurality of light sources is 4 to 8 mm.

5. The home appliance of claim 1, wherein the lighting device provides, at a lower end, a lighting printed circuit board (PCB) configured to control an operation of the plurality of light sources, and wherein the lighting PCB includes a PCB connector electrically connected to a controller.

6. The home appliance of claim 1, wherein the lighting device is configured to, based on an operating state of the home appliance or a user setting, change a color of the light emitted by the lighting device.

* * * * *